US007484945B2

(12) United States Patent
Okaichi et al.

(10) Patent No.: US 7,484,945 B2
(45) Date of Patent: Feb. 3, 2009

(54) COMPRESSOR FOR REFRIGERATOR-FREEZER HAVING A POROUS MEMBER

(75) Inventors: Atsuo Okaichi, Osaka (JP); Hiroshi Hasegawa, Osaka (JP); Fumitoshi Nishiwaki, Hyogo (JP)

(73) Assignee: Matsushita Electric Industrial Co., Ltd., Kadoma-shi (JP)

( * ) Notice: Subject to any disclaimer, the term of this patent is extended or adjusted under 35 U.S.C. 154(b) by 136 days.

(21) Appl. No.: 10/533,286

(22) PCT Filed: Sep. 24, 2004

(86) PCT No.: PCT/JP2004/014414

§ 371 (c)(1),
(2), (4) Date: Apr. 29, 2005

(87) PCT Pub. No.: WO2005/031164

PCT Pub. Date: Apr. 7, 2005

(65) Prior Publication Data

US 2006/0067846 A1 Mar. 30, 2006

(30) Foreign Application Priority Data

Sep. 26, 2003 (JP) ..... 2003-335775

(51) Int. Cl.
*F01C 1/63* (2006.01)
*F03C 2/00* (2006.01)
*F04C 18/00* (2006.01)

(52) U.S. Cl. ..... 418/63; 418/179; 418/181; 418/270; 418/DIG. 1

(58) Field of Classification Search ..... 418/63, 418/179, 181, 270, DIG. 1, 55.1–55.6
See application file for complete search history.

(56) References Cited

U.S. PATENT DOCUMENTS 3,684,412 A * 8/1972 Harlin et al. ..... 418/97
RE27,691 E * 7/1973 Harlin et al. ..... 418/97
4,447,196 A * 5/1984 Nagasaku et al. ..... 418/93

(Continued)

FOREIGN PATENT DOCUMENTS

JP 56-165788 12/1981

(Continued)

OTHER PUBLICATIONS

Chinese Office Action received in a corresponding application dated Aug. 17, 2007 with English translation (13 pages).

*Primary Examiner*—Theresa Trieu
(74) *Attorney, Agent, or Firm*—Kratz, Quintos & Hanson, LLP

(57) ABSTRACT

A projection of an upper bearing member is provided with a porous member, and a lower space between a rotational motor and a compression mechanism is defined into a lower compression mechanism-side space and a lower rotational motor-side space. With this structure, stirring effect of working fluid flowing in the lower compression mechanism-side space caused by rotation of the rotor is suppressed, and oil drops mixed in the working fluid are prevented from being finely divided by the stirring effect, the oil drops are allowed to fall due to the gravity in the lower compression mechanism-side space, and oil separating effect from the working fluid is enhanced.

26 Claims, 11 Drawing Sheets

U.S. PATENT DOCUMENTS

| | | | | |
|---|---|---|---|---|
| 4,545,742 | A | 10/1985 | Schaefer | |
| 5,402,655 | A * | 4/1995 | Mangyo et al. | 62/474 |
| 5,782,622 | A | 7/1998 | Ozu et al. | |
| 6,592,347 | B2 * | 7/2003 | Matsumoto et al. | 418/178 |

FOREIGN PATENT DOCUMENTS

| | | | | |
|---|---|---|---|---|
| JP | 58-085378 | | 5/1983 | |
| JP | 59034494 | A * | 2/1984 | 418/55.2 |
| JP | 61-87984 | | 5/1986 | |
| JP | 61-087984 | | 5/1986 | |
| JP | 61-155692 | | 7/1986 | |
| JP | 62-247188 | | 10/1987 | |
| JP | 1-253586 | | 10/1989 | |
| JP | 03015692 | A * | 1/1991 | 418/DIG. 1 |
| JP | 03-031598 | | 2/1991 | |
| JP | 05288179 | A * | 11/1993 | 418/63 |
| JP | 08028476 | A * | 1/1996 | |

* cited by examiner

COMPRESSOR FOR REFRIGERATOR-FREEZER HAVING A POROUS MEMBER

TECHNICAL FIELD

The present invention relates to a hermetical rotational compressor used for a refrigerator-freezer, an air conditioner and the like.

BACKGROUND OF THE INVENTION

Since a hermetical rotational compressor is compact in size and its structure is simple, the hermetical rotational compressor is widely used for a refrigerator-freezer, air conditioners and the like. Non-patent document, ["Air-Conditioning and Refrigeration handbook", new edition 5, volume II, machine", Air-Conditioning and Refrigeration Institute, 1993, paragraphs 30 to 43], describes structures of hermetical rotational compressors such as a rotary compressor and a scroll compressor. A structure of the conventional hermetical rotational compressor will be explained based on the rotary compressor and the scroll compressor with reference to FIGS. 8 to 10.

FIG. 8 is a vertical sectional view of the conventional rotary compressor. The rotary compressor shown in the drawings comprises a container 1, a shaft 2 having an eccentric portion 2*a*, a cylinder 3, a roller 4, a vane 5, a spring 6, an upper bearing member 7 having a discharge hole 7*a*, a lower bearing member 8, a stator 11 having coil ends 11*c* and 11*d* projecting from upper and lower end surfaces 11*a* and 11*b*, respectively, and a rotor 12 fitted over the shaft 2.

In the above structure, a portion comprising the stator 11 and the rotor 12 is called a rotational motor, and a portion which forms a suction chamber and a compression chamber (not shown) in the cylinder 3 and which compresses a working fluid as the rotor 12 rotates is called a compression mechanism.

An outer periphery of the stator 11 is provided with a plurality of notches 11*e* which function as passages of the working fluid. A gap 18 is provided between the stator 11 and the rotor 12. The container 1 is provided at its upper portion with an introduction terminal 13 for energizing the rotational motor from outside of the container 1, and a discharge pipe 15 for discharging the working fluid from the container 1 into a refrigeration cycle. The container 1 is provided at its side surface with a suction pipe 14 for introducing the working fluid from the refrigeration cycle into the compression mechanism. The container 1 is provided at its bottom with an oil reservoir 16 where refrigeration oil is reserved.

The operation of the rotary compressor having the above-described structure will be explained.

If the stator 11 is energized through the introduction terminal 13 to rotate the rotor 12, the roller 4 is eccentrically rotated by the eccentric portion 2*a*, and volumes of the suction chamber and the compression chamber are varied. With this, the working fluid is sucked into the suction chamber from the suction pipe 14 and is compressed in the compression chamber. The compressed working fluid supplied from the oil reservoir 16 is mixed with a refrigeration oil which lubricated the compression mechanism and, in this state, the working fluid is injected into a lower space 17 of the rotational motor through the discharge hole 7*a*.

The most of injected working fluid collides against a lower end surface 12*a* of the rotor 12 and then produces a strong turning flow by the rotation of the rotor 12. While the working fluid remains in the lower space 17 as a turning flow, a portion of the oil drops included in the working fluid attaches to an inner wall of the container 1 by a centrifugal force or drops downward due to gravity and returns into the oil reservoir 16.

In a state in which the working fluid includes the oil drops which are not separated, the most of working fluid passes through the notches 11*e* and the gap 18 from the lower space 17, and is injected toward an upper space 19 of the rotational motor. The injected working fluid flows toward the discharge pipe 15 but at that time, a portion of the working fluid passes in the vicinity of an upper end surface 12*b* of the rotor 12, and produces the turning flow due to the rotation of the rotor 12. While the working fluid stays in the upper space 19, a portion of the oil drop included in the working fluid attaches to the inner wall of the container 1 by the centrifugal force or drops downward due to the gravity and is separated, and returns into the oil reservoir 16 along the inner wall of the container 1 or a wall surface of the stator 11. The working fluid including the oil drops which are not yet separated is discharged from the discharge pipe 15.

FIG. 9 is a vertical sectional view of a conventional scroll compressor. The scroll compressor shown in FIG. 9 comprises a container 31, a shaft 32 having an eccentric portion 32*a*, a stationary scroll 33 having a spiral lap 33*a* and a discharge hole 33*b*, a moving scroll 34 having a spiral lap 34*a* and turning as the eccentric portion 32*a* eccentrically rotates, an upper bearing member 36 having the discharge hole 36*c* and supporting one end of the shaft 32, a stator 39 which has coil ends 39*c* and 39*d* projecting at right and left end surfaces 39*a* and 39*b*, respectively, and which is shrinkage fitted into the container 31, a rotor 40 shrinkage fitted over the shaft 32, and an auxiliary bearing member 41 supporting the other end of the shaft 32.

The lap 33*a* and the lap 34*a* are meshed with each other, and a plurality of suction chambers 37 and compression chambers 38 are formed in the stationary scroll 33 and the moving scroll 34. In the above structure, a structure comprising the stator 39 and the rotor 40 is called a rotational motor, and a structure which forms the suction chambers 37 and the compression chambers 38 and which compresses a working fluid as the rotational motor rotates is called a compression mechanism.

An outer periphery of the stator 39 is provided with a plurality of notches 39*e* which function as passages of the working fluid. A gap 48 is formed between the stator 39 and the rotor 40. The container 31 is provided with an introduction terminal 42 for energizing the rotational motor from outside of the container 31. The container 31 is also provided with a suction pipe 43 for introducing the working fluid into the suction chambers 37 from the refrigeration cycle, and a discharge pipe 44 for discharging the working fluid into the refrigeration cycle from the container 31. Refrigeration oil is reserved in an oil reservoir 45 formed in a lower portion of the container 31, and the refrigeration oil is drawn up by an oil supply pump 46 from the oil reservoir 45, and is supplied to the compression mechanism.

The operation of the scroll compressor having the above-described structure will be explained.

If the stator 39 is energized through the introduction terminal 42 to rotate the rotor 40, the moving scroll 34 turns, and volumes of the suction chambers 37 and the compression chambers 38 are varied. With this, the working fluid is sucked from the suction pipe 43 into the suction chambers 37, and is compressed in the compression chambers 38. The compressed working fluid is supplied from the oil reservoir 45, and is mixed with oil drops of the refrigeration oil which lubricated a sliding surface of the compression mechanism and, in this state, the working fluid is injected into a right space 47 of the rotational motor through the discharge holes 33*b* and 36*c*.

The most of injected working fluid produces a turning flow by rotation of a right end surface 40*a* of the rotor 39. While the working fluid stays in the right space 47 as the turning flow, a portion of the oil drops included in the working fluid attach to the inner wall of the container 1 by the centrifugal force or drop due to the gravity, and is separated from the working fluid and returns into the oil reservoir 45.

In a state in which the working fluid includes oil drops which are not yet separated, the working fluid passes through the notches 39*e* or the gap 48 from the right space 47, and is injected into a left space 49 of the rotational motor. The most of injected working fluid flows toward the discharge pipe 44 but at that time, a portion of the working fluid passes in the vicinity of a left end surface 40*b* of the rotor 40, and produces a turning flow due to rotation of the rotor 40. While the working fluid remains in the left space 49, a portion of the oil drops included in the working fluid attaches to the inner wall of the container 1 by the centrifugal force or drops downward due to gravity and is separated and returns into the oil reservoir 45. The working fluid including the oil drops which are not yet separated is discharged from the discharge pipe 44.

In the hermetical type compressor such as the rotary compressor and the scroll compressor, in order to lubricate the sliding surface of the compression mechanism and to seal the gap, the compressed working fluid and refrigeration oil are mixed, a portion of the refrigeration oil reserved in the oil reservoir is discharged out from the container 1, 31 of the compressor in the course of operation of the compressor, but in the case of a compressor having a high amount of discharged refrigeration oil, since the oil level of the refrigeration oil in the oil reservoir 16, 45 is lowered, the supply oil amount becomes insufficient, and the lubrication of the compression mechanism becomes insufficient, the reliability is deteriorated, the sealing of the compression mechanism becomes insufficient, and the efficiency of the compressor is deteriorated. Further, the refrigeration oil discharged from the compressor attaches to an inner wall of a tube of a heat exchanger to deteriorate the heat transfer coefficient between the working fluid and a wall surface in the heat exchanger tube. Thus, the performance of the refrigeration cycle is deteriorated. Therefore, the oil separating efficiency of the working fluid in the container 1, 31 of the compressor is enhanced, and the discharging amount of the refrigeration oil is reduced.

As a structure for separating the refrigeration oil from the working fluid, there is a method to use an oil separating plate provided on an upper portion of the rotor 12 of the rotary compressor as shown in a patent document, [Japanese Patent Application Laid-open No.H8-28476 (paragraph 6, FIGS. 1 to 3)] FIG. 10 shows a detailed sectional view of a periphery of the oil separating plate. The rotor 12 has an upper end plate 21*a* and a lower end plate 21*b* for closing inserting holes of a permanent magnet 20. A plurality of through holes 12*c* formed in the rotor 12 are provided to penetrate the rotor 12 in the vertical direction, and an oil separating plate 23 which is disposed above exits of the through holes 12*c* and which forms an oil separating space 22 between itself and an upper end surface of the rotor 12 are fixed to the rotor 12 by a fixing member 24.

According to the compressor having such a structure, a portion of the working fluid including oil drops discharged into the lower space 17 of the rotational motor from the compression mechanism flows into the oil separating space 22 through the through holes 12*c* formed in the rotor 12. The working fluid is radially discharged from the outer peripheral exit of the oil separating plate 23, and blows against the coil end 11*d* of the stator 11, and separates the refrigeration oil included in the working fluid. Only the working fluid from which the refrigeration oil is separated flows upward, and is discharged out from the discharge pipe 15 provided on the upper portion in the container 1. On the other hand, refrigeration oil attached to the coil end 11*d* of the stator 11 drops downward and returns into the oil reservoir 16 formed in the bottom of the container 1.

As described above, in the conventional rotary compressor, the most of working fluid injected into the lower space 17 of the rotational motor from the discharge hole 7*a* of the compression mechanism produces the strong turning flow by rotation of the rotor 12. The working fluid injected into the upper space 19 also produces the turning flow due to the rotation of the rotor 12. Similarly, the most of working fluid injected into the right space 47 and the left space 49 of the scroll compressor produces the turning flow due to the rotation of the rotor 40.

At that time, the oil drops of the refrigeration oil included in the working fluid are stirred by the turning flow and are finely divided. Since the turning flow in the lower space 17, the upper space 19, the right space 47 and the left space 49 increases the flow speed of the working fluid, the oil drops are prone to be transported by the working fluid. Therefore, it is difficult to completely separate the refrigeration oil from the working fluid by the separating method by means of the centrifugal force and gravity. Each of the lower end surface 12*a* and the upper end surface 12*b* of the rotor 12 is provided with a balancer 12*d* for overcoming the unbalance state of the roller 4 and the eccentric portion 2*a* of the shaft 2. Similarly, each of the right end surface 40*a* and the left end surface 40*b* of the rotor 40 is provided with a balancer 40*c*. In the case of a brushless DC motor, a bolt or a rivet (not shown) is provided for fixing a laminated steel plate and the magnet forming the rotor. As a result, the end surface of the rotor is formed with a large number of asperities, and the stirring of the working fluid is enhanced by rotating the asperities. Therefore, the oil drops of the refrigeration oil included in the working fluid are divided more finely, and it becomes difficult to separate the refrigeration oil from the working fluid.

As a method for separating the stirred and finely divided oil drops from the working fluid, the structure shown in FIG. 10 is used. In this case, however, with regard to the working fluid flowing from the lower space 17 toward the upper space 19 of the rotational motor, this method is effective only for the working fluid passing through the through holes 12*c* formed in the rotor 12, and it is impossible to separate the oil drops from the working fluid passing through the notches 11*e* of the stator 11 and the gap 18 between the stator 11 and the rotor 12. Further, the oil separating plate 23 is provided on the upper end surface 12*b* of the rotor. This structure promotes the stirring of the working fluid in the upper space 19 of the rotational motor, and there is a problem that it is more difficult to separate the refrigeration oil in the upper space 19.

As another method, volumes of the lower space 17 and the upper space 19 of the rotational motor are increased, and a time during which the working fluid stays in such spaces is lengthened, and separation of the oil drop of the refrigeration oil is promoted by the gravity. However, in this case also, it is difficult to eliminate the influence of the stirring, and there is another problem that the compressor is increased in size.

The above description is based on the vertical type rotary compressor or the lateral type scroll compressor, but if the working fluid passes through an end surface of the rotor while a refrigerant discharged from the compression mechanism is discharged from the discharge pipe provided on the container, irrespective of a difference between the vertical type and the lateral type or irrespective of a difference of the compressing manners, the same problems mentioned above exist.

The above problems are generated irrespective of kinds of the working fluid which are used. However, the problems are particularly severe when the refrigeration cycle uses a working fluid mainly comprising carbon dioxide as a main ingredient, since the pressure of the working fluid discharged from the compression chamber exceeds a critical pressure, the working fluid in the container is brought into a supercritical state, and an amount of refrigeration oil solved in the working fluid is increased, thereby making it more difficult to separate the oil in the container.

The present invention has been accomplished to solve the above problems, and it is an object of the invention to provide a compressor capable of easily and inexpensively enhancing the oil separating efficiency without deteriorating the efficiency of the rotational motor, capable of reducing the amount of refrigeration oil to be removed from the container, and capable of enhancing the reliability of the compressor and obtaining an efficient refrigeration cycle.

As described above, according to the present invention, porous members are provided in the space between the rotational motor and the compression mechanism and the space between the rotational motor and the discharge pipe and the spaces are defined. Thus, the stirring phenomenon by turning flow caused due to rotation of the rotor and the stirring phenomenon caused by rotation of the asperities such as the balancer provided on the end surface of the rotor can be pushed into the space on the side of the rotational motor defined by the porous member so that the oil drops of the refrigeration oil mixed in the working fluid are prevented from being divided finely by the stirring phenomenon.

With this the effect that the oil drops falls due to the gravity and are separated is promoted, and the oil separating efficiency can be enhanced, and reliability and efficiency of the compressor and the refrigeration cycle using the compressor can be enhanced.

SUMMARY OF THE INVENTION

A first aspect of the present invention provides a compressor comprising a compression mechanism for compressing working fluid, a rotational motor including a stator, a rotor for driving the compression mechanism and a container for accommodating the compression mechanism and the rotational motor, in which the compressed working fluid flows from the compression mechanism to the rotational motor, wherein a space between the compression mechanism and the rotational motor is defined by a porous member.

With this aspect, turning flow caused by rotation of the rotor is not generated in the working fluid in the space defined. Thus, oil drops caused by stirring effect of the turning flow are not finely divided, falling of the oil drops from the working fluid due to the gravity is promoted, and the oil separating effect can be enhanced.

A second aspect of the invention provides a compressor comprising a compression mechanism for compressing working fluid, a rotational motor including a stator, a rotor for driving the compression mechanism and a container for accommodating the compression mechanism and the rotational motor, in which the container includes a discharge pipe on the opposite side of the compression mechanism with respect to the rotational motor, and the compressed working fluid flows from the rotational motor to the discharge pipe, wherein a space between the rotational motor and the discharge pipe is defined by a porous member.

With this aspect, turning flow caused by rotation of the rotor is not generated in the working fluid in the space defined. Thus, oil drops caused by stirring effect of the turning flow are not finely divided, falling of the oil drops from the working fluid due to the gravity is promoted, and the oil separating effect can be enhanced.

A third aspect of the invention provides a compressor comprising a compression mechanism for compressing working fluid, a rotational motor including a stator, a rotor for driving the compression mechanism and a container for accommodating the compression mechanism and the rotational motor, in which the container includes a discharge pipe on the opposite side of the compression mechanism with respect to the rotational motor, and the compressed working fluid flows from the compression mechanism to the discharge pipe through the rotational motor, wherein a space between the compression mechanism and the rotational motor is defined by one of porous members, and a space between the rotational motor and the discharge pipe is defined by the other porous member.

With this aspect, turning flow caused by rotation of the rotor is not generated in the working fluid in the space defined. Thus, oil drops caused by stirring effect of the turning flow are not finely divided, falling of the oil drops from the working fluid due to the gravity is promoted, and the oil separating effect can be enhanced.

According to a fourth aspect of the invention, in the compressor of any one of the first to third aspects, the porous member is mounted on an element other than the rotor and a shaft fixed to the rotor.

With this aspect, since an element other than the rotor is not rotated, the porous member is not rotated either. Thus, it is possible to prevent the turning flow from being generated in the working fluid in the space defined by the porous member.

According to a fifth aspect of the invention, in the compressor of the fourth aspect, the compression mechanism includes a bearing member which supports the shaft, and the porous member is mounted on the bearing member.

With this aspect, the porous member is mounted on the bearing member which is the element other than the rotor, the turning flow is prevented from being generated, and a column for supporting the porous member is unnecessary, and the structure can be simplified.

According to a sixth aspect of the invention, in the compressor of the fifth aspect, the bearing member includes a projection provided on a side of the rotational motor, and the porous member is mounted on a groove formed in an outer peripheral surface of the projection.

With this aspect, since the porous member is mounted on the groove, the compressor can be assembled using no bolt, and the compressor can be produced inexpensively.

According to a seventh aspect of the invention, in the compressor of the fourth aspect, the porous member is mounted on an inner wall of the container.

With this aspect, since the porous member is mounted on the inner wall of the container which is an element other than the rotor, the turning flow is prevented from being generated, and the rotational motor and the compression mechanism can be used as they are without remaking the rotational motor and the compression mechanism.

According to an eighth aspect of the invention, in the compressor of the fourth aspect, the compression mechanism includes a bearing member which supports the shaft and an auxiliary bearing member which supports the shaft together with the bearing member from both sides of the shaft on the opposite side from the bearing member with respect to the rotor.

With this aspect, since the porous member is mounted on the auxiliary bearing member which is an element other than the rotor, the turning flow is not generated, and the rotational motor can be used as it is without remaking the rotational motor.

According to a ninth aspect, in the compressor of any one of the first to third aspects, the porous member is made of porous material such as porous metal, porous resin and the like.

With this aspect, since the porous material has a wide surface area which comes into contact with the working fluid and the oil which pass through the porous member, the oil drops are prone to attach and grow, and the oil can be separated easily.

According to a tenth aspect, in the compressor of the ninth aspect, the porous member is formed into a plate-like shape.

With this aspect, since the surface of the plate is flat, disturbance of flow is not generated by the peel on the surface, and deterioration of the efficiency of the compressor caused by kinetic energy loss can be prevented.

According to an eleventh aspect, in the compressor of the ninth aspect, a central portion of the porous member is thicker than an outer periphery of the porous member.

With this aspect, the passage resistance of the outer periphery of the porous member becomes smaller than that of the central portion of the porous member, and since the working fluid is dispersed toward the outer periphery, the flow speed of the working fluid is reduced, and the oil separating effect is enhanced.

According to a twelfth aspect, in the compressor of any one of the first to third aspects, the porous member is made of mesh such as metal thin wire, glass wool, ceramic wool and the like.

With this aspect, since the mesh has a wide surface area which comes into contact with the working fluid and oil which pass through the mesh, the oil drops are prone to attach and grow, and the oil separating effect can further be enhanced.

According to a thirteenth aspect of the invention, in the compressor of the twelfth aspect, the mesh is enveloped by a plate member having an opening.

With this aspect, the plate member protects the mesh and prevents the mesh from being deformed and thus, the oil separating effect of the mesh can be maintained.

According to a fourteenth aspect of the invention, in the compressor of the twelfth aspect, a central portion of the mesh is higher density than that of an outer periphery of the mesh.

With this aspect, since the passage resistance of the outer periphery of the mesh is smaller than that of the central portion of the mesh, the working fluid is dispersed toward the outer periphery and thus, the flow speed of the working fluid is reduced and the oil separating effect is enhanced.

According to a fifteenth aspect, in the compressor of any one of the first to third aspects, the porous member is made of porous plate such as honeycomb, punching metal and the like.

With this aspect, since the passage resistances of an inlet, a hole wall and an outlet of each of the small holes of porous plate are high, the flow speed of the working fluid is largely reduced. Thus, the oil drops can easily be separated from the working fluid.

According to a sixteenth aspect of the invention, in the compressor of the fifteenth aspect, the porous plate comprises a plurality of porous plates laminated on one another.

With this aspect, since the porous plate comprises the plurality of porous plates laminated on one another, the passage resistance is further increased and thus, the flow speed of the working fluid is further reduced and the oil drops can be separated more effectively.

According to a seventeenth aspect of the invention, in the compressor of the fifteenth aspect, the porous plate has holes, and a diameter of a hole closer to a central portion of the porous plate is smaller than that of a hole closer to an outer periphery of the porous plate.

With this aspect, the passage resistance of the outer periphery of the porous plate becomes smaller than that of the central portion of the porous plate, the working fluid is dispersed toward the outer periphery, the flow speed of the working fluid is reduced and the oil separating effect is enhanced.

According to an eighteenth aspect, in the compressor of any one of the first to third aspects, the porous member is made of non-magnetic material.

With this aspect, if the porous member is made of non-magnetic material, the influence exerted on the magnetic circuit of the rotational motor is small, and the oil separating efficiency can be enhanced without deteriorating the efficiency of the rotational motor.

According to a nineteenth aspect, in the compressor of any one of the first to third aspects, the porous member is made of insulative material.

With this aspect, if the porous member is made of insulative material, it is unnecessary to take the electrical insulation performance into consideration, the porous member can be mounted in contact with the stator or the coil end, and a gap can be eliminated. If the gap is eliminated, the influence of the turning flow can be prevented, the stirring effect can be reduced, and the oil separating efficiency can be enhanced.

According to a twentieth aspect, in the compressor of any one of the first to third aspects, carbon dioxide is used as the working fluid.

With this aspect, carbon dioxide as an environment-friendly refrigerant can be used as the working fluid.

According to a twenty first aspect, in the compressor of any one of the first to third aspects, the compression mechanism is of a rotary type.

With this aspect, in a rotary compressor having a space in which working fluid comes into contact with a rotor end surface, the space is defined, the stirring effect caused by the turning flow of the working fluid in the defined space can be prevented more remarkably, and the oil separating effect can be enhanced.

According to a twenty second aspect, in the compressor of any one of the first to third aspects, the compression mechanism is of a scroll type.

With this aspect, in a scroll compressor, the stirring effect caused by the turning flow is prevented, and the oil separating effect can be enhanced.

DETAILED DESCRIPTION

Figure 8:
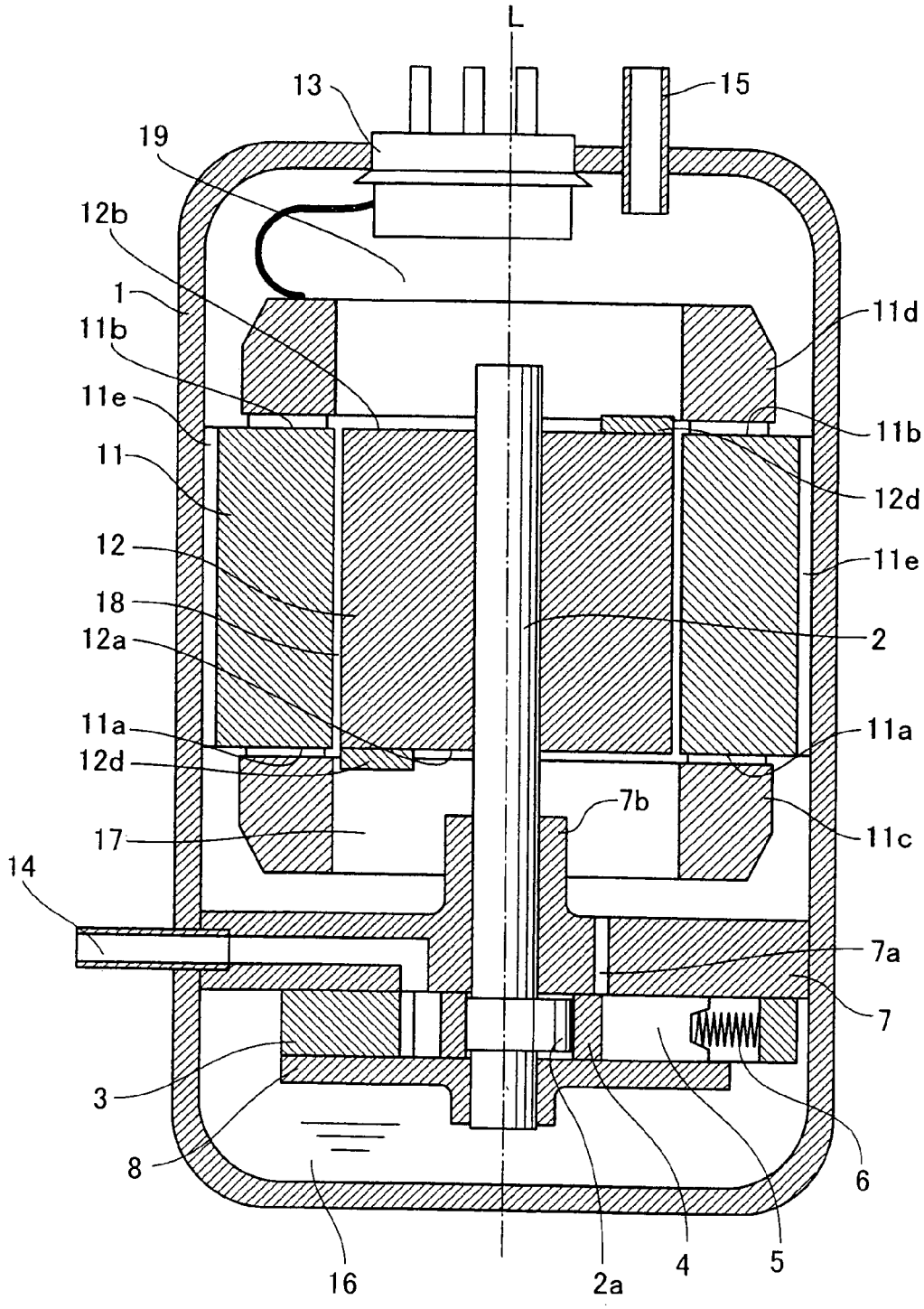
Fig. 8 PRIOR ART
FIG. 8 is a vertical sectional view of a conventional rotary compressor.

A compressor of a first embodiment of the present invention is a rotary compressor, and has a similar structure as that of the conventional rotary compressor explained using FIG. 8, and the same elements are designated with the same symbols.

Figure 1:
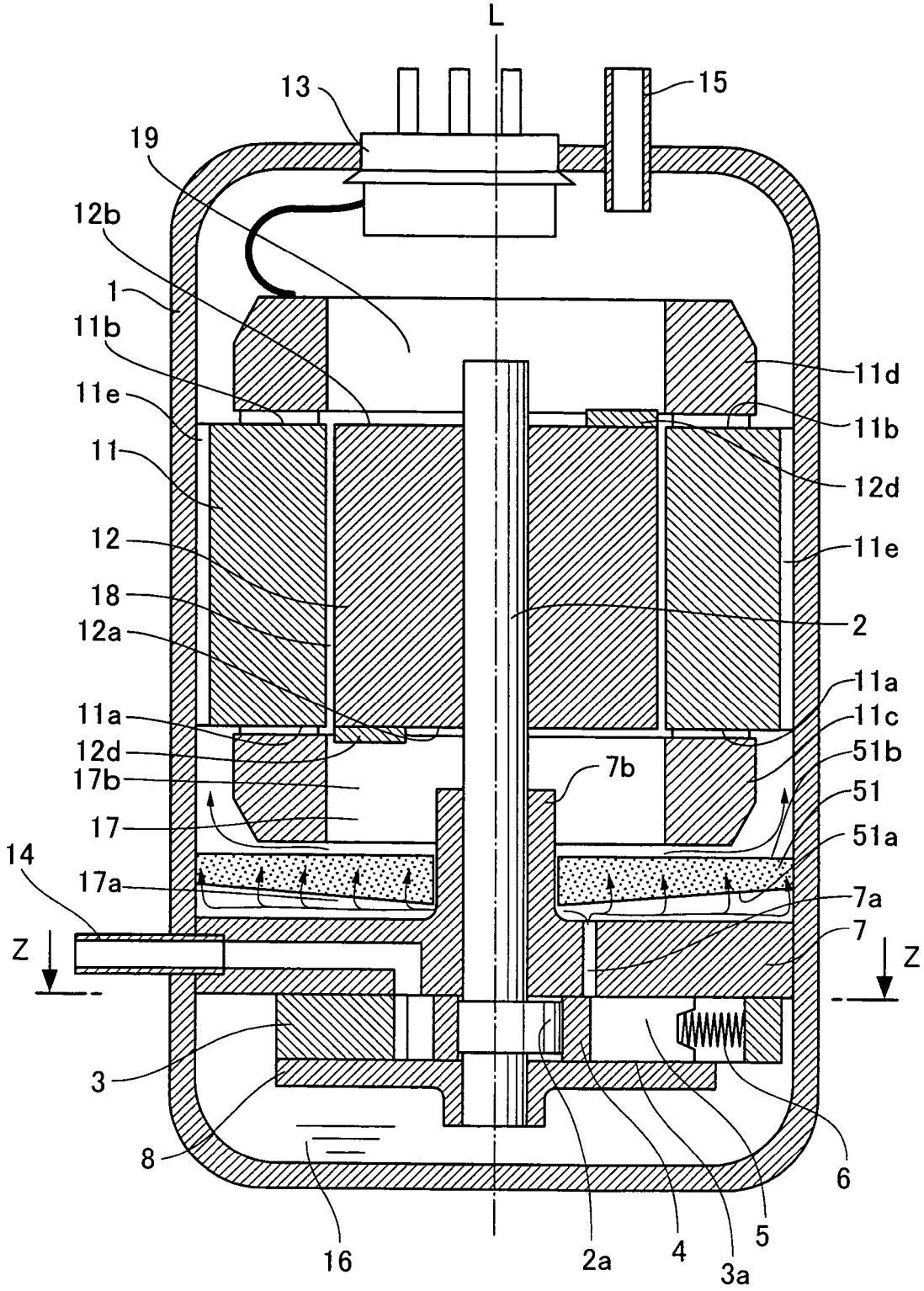
FIG. 1 is a vertical sectional view of a rotary compressor according to a first embodiment of the present invention.
Figure 2:
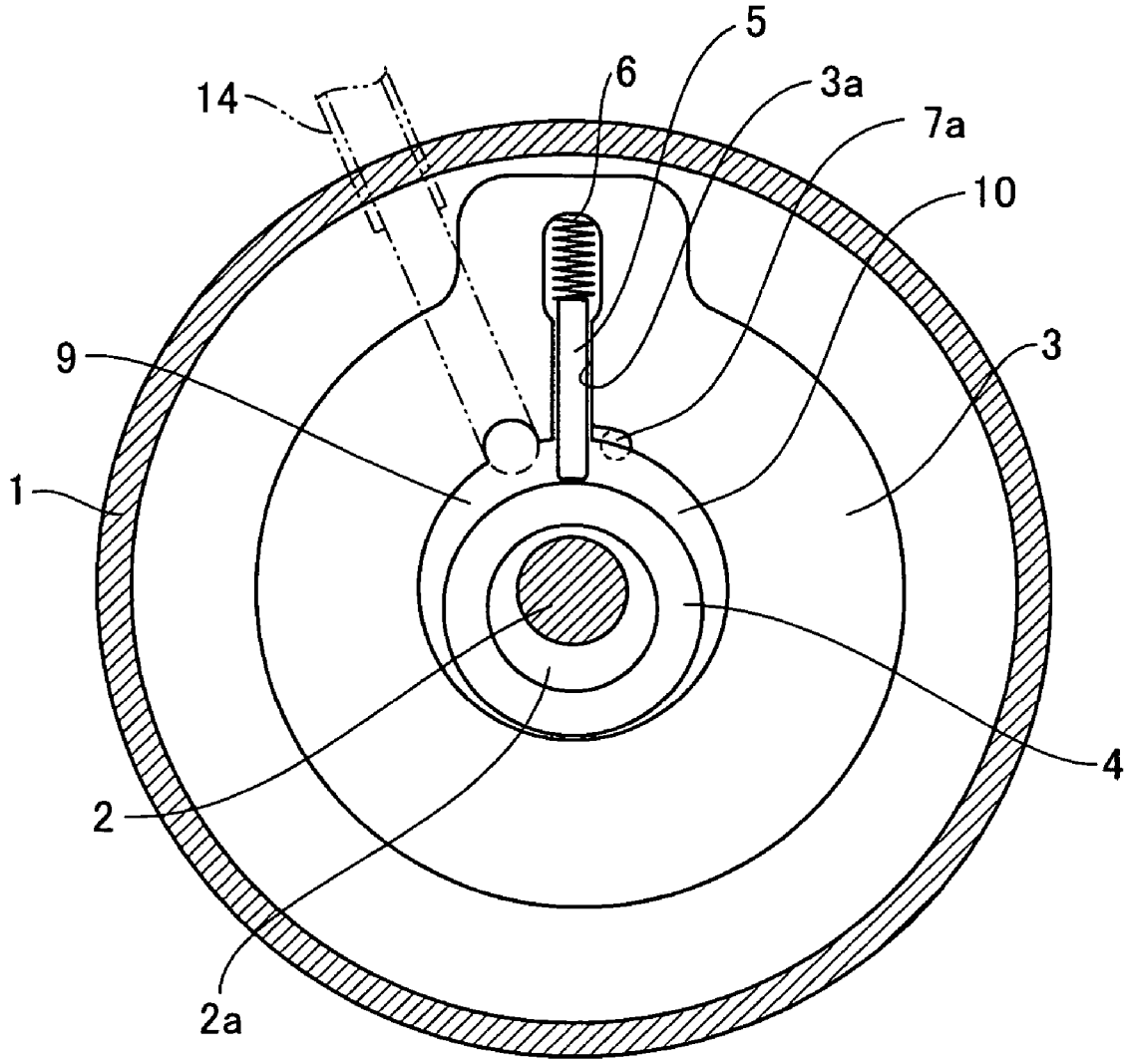
FIG. 2 is a lateral sectional view of the rotary compressor shown in FIG. 1 taken along the arrow Z-Z in FIG. 1.

FIG. 1 is a vertical sectional view of a rotary compressor according to the first embodiment of the invention, and FIG. 2 is a lateral sectional view of the rotary compressor shown in FIG. 1 taken along the arrow Z-Z in FIG. 1.

The rotary compressor shown in the drawings comprises a container 1, a compression mechanism disposed at a lower portion in the container 1, and a rotational motor disposed at an upper portion in the container 1. The compression mechanism includes a shaft 2 which can rotate around a center axis L, a cylinder 3, a roller 4 which is fitted over an eccentric portion 2*a* of the shaft 2 and which eccentrically rotates inside the cylinder 3 as the shaft 2 rotates, a vane 5 which reciprocates in a vane groove 3*a* of the cylinder 3 in a state in which a tip end of the vane 5 is in contact with the roller 4, a spring 6 for pushing the vane 5 against the roller 4, an upper bearing member 7 having a discharge hole 7*a* and a projection 7*b* and supporting the shaft 2 at an upper side of the cylinder 3, and a lower bearing member 8 supporting the shaft 2 at a lower side of the cylinder 3. A space between the cylinder 3 and the roller 4 sandwiched between the upper bearing member 7 and the lower bearing member 8 is divided by the vane 5 into a suction chamber 9 and a compression chamber 10.

The rotational motor includes a stator 11 which is shrinkage fitted into the container 1, and a rotor 12 which is shrinkage fitted over the shaft 2. The stator 11 is provided with a coil end 11*c* projecting from a lower end surface 11*a* of the stator 11, and a coil end 11*d* projecting from an upper end surface 11*b*. The stator 11 is formed by laminating steel plates from its lower end surface 11*a* to its upper end surface 11*b*. The lower end surface 12*a* and the upper end surface 12*b* of the rotor 12 can be provided with balancers 12*d* if necessary. A porous member 51 is mounted on the upper bearing member 7 of the compression mechanism. The porous member 51 divides a space between the compression mechanism and the rotational motor into a lower compression mechanism-side space 17*a* and a lower rotational motor-side space 17*b*.

A plurality of notches 11*e* are provided between an outer peripheral side of the stator 11 and an inner wall of the container 1. The notches 11*e* function as passages for a working fluid. A gap 18 is provided between the stator 11 and the rotor 12. The container 1 is provided with an introduction terminal 13 for energizing the stator 11 from outside of the container 1, a suction pipe 14 for introducing the working fluid into the suction chamber 9 of the compression mechanism from the refrigeration cycle. The container 1 is provided with a discharge pipe 15 which discharges working fluid from the container 1 into the refrigeration cycle. The discharge pipe 15 is provided on the opposite sides from the compression mechanism with respect to the rotational motor. FIG. 1 also shows that the discharge pipe 15 is provided on the opposite side from the compression mechanism with respect to the porous member 51. The refrigeration oil is reserved in an oil reservoir 16 formed in a bottom of the container 1.

As compared with the conventional rotary compressor shown in FIG. 8, the rotary compressor of this embodiment is characterized in that the porous member 51 is provided in the lower space 17 of the rotational motor. That is, the porous member 51 provided in the lower space 17 is made of porous material such as porous metal or porous resin. A peripheral edge of the porous member 51 is formed into a disk-like shape which comes into contact with an inner side surface of the container 1. The porous member 51 is provided at its central portion with a through hole into which an outer periphery of the projection 7*b* of the upper bearing member 7 can be fitted. The through hole intersects with upper and lower end surfaces of the porous material. A lower end surface 51*a* of the porous member 51 projects downward in a convex manner. The porous member 51 is fitted over the projection 7*b*, the lower space 17 of the rotational motor is divided into the lower compression mechanism-side space 17*a* on the side of the compression mechanism and the lower rotational motor-side space 17*b* on the side of the rotational motor.

The operation of the rotary compressor having the above-described structure will be explained.

If the stator 11 is energized through the introduction terminal 13 to rotate the rotor 12, the roller 4 is eccentrically rotated by the eccentric portion 2*a* of the shaft 2, and volumes of the suction chamber 9 and the compression chamber 10 are varied. With this, the working fluid is drawn into the suction chamber 9 from the suction pipe 14, and is compressed in the compression chamber 10. The compressed working fluid is supplied from the oil reservoir 16, and lubricates a sliding surface of the compression mechanism, and is mixed with oil drops of refrigeration oil which seals the gap, and in this state, the working fluid is injected into the lower space 17 which is a flowing place of the working fluid between the compression mechanism and the rotational motor from the discharge hole 7*a* formed in the upper bearing member 7.

The working fluid which was injected into the lower space 17 stays in the lower compression mechanism-side space 17*a* which is defined by the porous member 51 and where the working fluid is not affected by rotation of the rotor 12. While the working fluid stays in the lower compression mechanism-side space 17*a*, a portion of the oil drops included in the working fluid attaches to the inner wall of the container 1 or falls due to the gravity and is separated, and returns into the oil reservoir 16.

Thereafter, the working fluid passes through the porous member 51. At that time, since the flow speed of the working fluid is reduced, the oil drops are separated from the working fluid in the porous member 51.

The working fluid which passed through the porous member 51 flows into the lower rotational motor-side space 17*b*, and causes the turning flow by the influence of rotation of the rotor 12, a portion of the oil drops included in the working fluid attaches to the inner wall of the container 1 by the centrifugal force of the turning flow or falls due to the gravity and is separated from the working fluid and returns into the oil reservoir 16.

Further, working fluid which includes oil drops which are not separated from the working fluid passes through notches 11*e* and gap 18 from the lower rotational motor-side space 17*b*, and flows into the upper space 19 of the rotational motor. The working fluid which flowed into the upper space 19 from the notches 11*e* flows toward the discharge pipe 15. At that time, a portion of the working fluid passes in the vicinity of the upper end surface 12*b* of the rotor 12, and causes the turning flow by the influence of the rotation of the rotor 12. Working fluid which flowed into the upper space 19 from the gap 18 also flows toward the discharge pipe 15. At that time the working fluid also causes the turning flow by the influence of the rotation of the rotor 12.

On the other hand, a portion of the oil drops included in the working fluid attaches to the inner wall of the container 1 by the centrifugal force of the turning flow, or drops due to the gravity, and is separated from the working fluid, and returns to the oil reservoir 16 along the inner wall of the container 1 or a wall surface of the stator 11. The working fluid including oil drops which are not yet separated is discharged from the discharge pipe 15.

With such a structure, since the lower compression mechanism-side space 17*a* is separated from the lower rotational motor-side space 17*b* by the porous member 51, the turning flow caused in the lower rotational motor-side space 17*b* by the rotation of the rotor 12 is not transmitted to the lower compression mechanism-side space 17*a*. Further, the porous member 51 is fixed to an element other than the rotor 12 and the shaft 2 and the porous member 51 does not rotate. Therefore, turning flow caused by the porous member 51 is not generated in the lower compression mechanism-side space 17*a*.

Therefore, according to the rotary compressor of the embodiment, the working fluid is compressed by the compression mechanism and is discharged into the lower compression mechanism-side space 17*a* from the discharge hole 7*a* of the upper bearing member 7. The flow speed of this working fluid is not increased by the turning flow, and the ability of the working fluid which transports the oil drops of the refrigeration oil is lowered as compared with the conventional compressor. Therefore, oil separation effect generated by the density difference between the working fluid and the refrigeration oil in the lower compression mechanism-side space 17*a* is promoted. Further, the oil drops of the refrigeration oil are prevented from being divided finely by the turning flow and thus, the oil separating effect by the density difference between the working fluid and refrigeration oil is further promoted, and the oil separating efficiency can be enhanced.

The working fluid passes through the porous member 51 and moves from the lower compression mechanism-side space 17*a* toward the lower rotational motor-side space 17*b*. At that time, since the passage resistance in the porous member 51 is large, the flow speed of the working fluid is further reduced. The lower end surface 51*a* of the porous member 51 projects downward in the convex manner, a thickness of the central portion of the disk-like shape of the porous member 51 is thick and a thickness of its peripheral portion is thin. Therefore, working fluid which is discharged from the discharge hole 7*a* of the upper bearing member 7 and which collides against the central portion of the disk-like shape of the porous member 51 is dispersed toward the periphery along the convex surface shape of the lower end surface 51*a*, and its flowing width is increased, and the flow speed of the working fluid passing through the porous member 51 is further reduced. Since the central portion of the porous member 51 is thick, resistance of the working fluid passing through the central portion is greater than that of the working fluid passing through the periphery.

Therefore, of the working fluid which is discharged from the discharge hole 7*a* of the upper bearing member 7 and which collides against the central portion of the disk-like shape of the porous member 51, an amount of working fluid which passes through the porous member 51 at the time of collision is further reduced, and an amount of working fluid which is once dispersed in the lower compression mechanism-side space 17*a* and then passes through the porous member 51 is increased, and the flow speed of the working fluid which passes through the porous member 51 is further reduced. Since the flow speed of the working fluid in the porous member 51 is reduced, the ability of the working fluid for transporting the refrigeration oil is reduced, and fine oil drops which can not be separated from the working fluid in the lower compression mechanism-side space 17*a* are easily be separated by the density difference between the working fluid and the refrigeration oil when the fine oil drops pass through the porous member 51.

The porous member 51 has a wide surface area with which the working fluid and the refrigeration oil come into contact. Therefore, the oil drops of the refrigeration oil easily attach to the porous member 51 and are prone to grow, and the oil drops fall downward of the porous member 51 by the density difference and thus, the oil separating effect is promoted.

As described above, since the porous member 51 is provided, the oil separating effect in the lower compression mechanism-side space 17*a* is promoted, and working fluid from which oil drops are largely separated flows into the lower rotational motor-side space 17*b* where stirring effect is generated by the turning flow and the rotation of the asperities such as the balancer 12*d* of the lower end surface 12*a* of the rotor 12. Thus, it is possible to minimize the possibility that the oil separating effect becomes difficult due to the turning flow and the stirring effect in the lower rotational motor-side space 17*b*, and the mass of the refrigeration oil included in the working fluid discharged from the discharge pipe 15 is reduced.

Since the porous member 51 is fitted over the projection 7*b* of the upper bearing member 7, the constituent parts of the conventional rotary compressor can be used as they are, and the compressor can be produced inexpensively. Since the porous member 51 is fixed to the upper bearing member 7 which supports the shaft 2, it is easy to position the porous member 51 in the direction along the center axis L in the space between the rotational motor and the compression mechanism, and especially since the positioning member such as a spacer is unnecessary, the compressor can be produced inexpensively.

The space is defined by the porous member 51 made of porous metal or porous resin, the lower end surface 51*a* of the porous member 51 projects downward in the convex manner, the porous member 51 is provided at its central portion with the through hole into which the projection 7*b* can be fitted, the periphery of the porous member 51 can be precisely formed into the shape which agrees to the inner side surface of the container 1 and thus, the oil separating effect can be exhibited at full stretch.

The porous member 51 is of plate-like in shape, and the upper end surface 51*b* of the porous member 51 which comes into contact with the turning flow generated by the rotation of the rotor 12 in the lower rotational motor-side space 17*b* is flat. Therefore, turbulence caused by peel of the turning flow is not easily generated on the surface of the porous member 51. Thus, the efficiency of the compressor is not deteriorated by loss of kinetic energy caused by turbulent flow.

If the porous member 51 is made of non-magnetic material, influence on a magnetic circuit of the rotational motor is small, and the oil separating efficiency can be enhanced without deteriorating the efficiency of the rotational motor.

Since the porous member 51 is made of insulative material such as resin and ceramic, the porous member 51 can be disposed in contact with the coil end 11*c* of the stator 11. Therefore, it is unnecessary to provide a gap between the coil end 11*c* and the porous member 51 to take the electrical insulation performance into consideration. Therefore, it is unnecessary to increase the compressor in size so as to secure the gap between the coil end 11*c* and the porous member 51, and the embodiment can be realized in the container 1 having the same size as that of the conventional container.

It is preferable that the surface of the porous member 51 is lipophobic. If the surface of the porous member 51 is lipophobic, the refrigeration oil is not easily held on the surface of the porous member 51. Thus, the refrigeration oil attaches the porous member 51 and a particle diameter of the refrigeration oil is increased, and the refrigeration oil is prone to fall downward of the porous member 51 by the density difference. Therefore, refrigeration oil separated from the working fluid can easily return to the oil reservoir 16.

The vertical rotary compressor is explained in this embodiment, but if most of working fluid discharged from the compression mechanism passes in the vicinity of the rotor 12 until the working fluid is discharged from the discharge pipe 15 provided in the container 1 irrespective of the difference between the vertical type and the lateral type, or irrespective of the difference of compressing manners, the same effect can be obtained.

In a compressor in which the working fluid injected from the discharge hole 7*a* collides directly against the lower end surface 12*a* of the rotor 12 like the conventional rotary compressor, if the lower space 17 is defined by the porous member 51, the oil separating effect is exhibited more remarkably.

Second Embodiment

A compressor of a second embodiment of the present invention is similar to the rotary compressor of the first embodiment explained using FIG. 1 and the conventional rotary compressor explained using FIG. 8. The same elements are designated with the same symbols. Explanation of the same structure and the same operation will be omitted.

Figure 3:
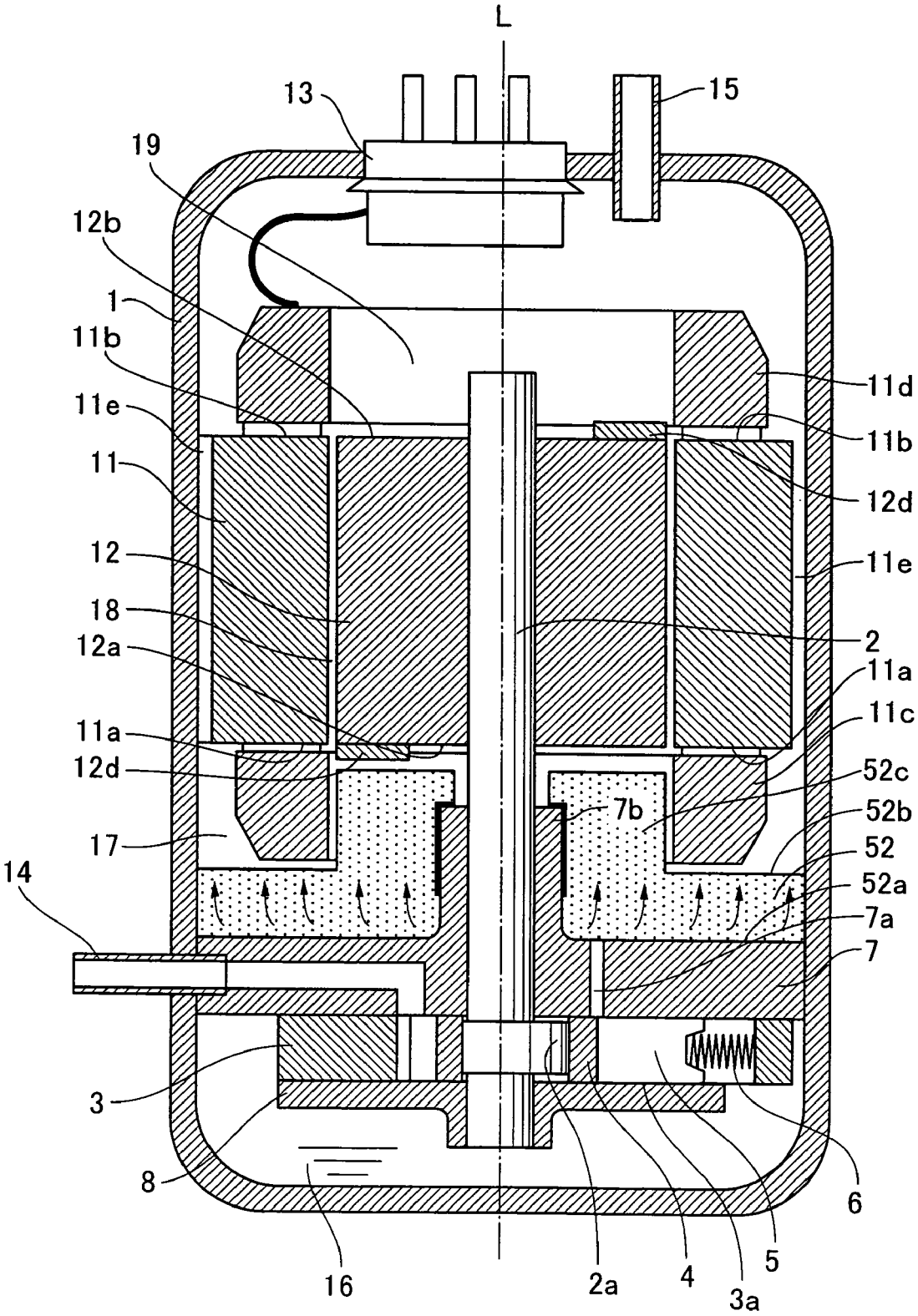
FIG. 3 is a vertical sectional view of a rotary compressor according to a second embodiment of the invention.

FIG. 3 is a vertical sectional view of a rotary compressor according to the second embodiment of the invention.

The rotary compressor of the second embodiment is different from the conventional rotary compressor shown in FIG. 8 in that the porous member 52 is provided in the lower space 17 of the rotational motor. That is, the porous member 52 provided in the lower space 17 is made of porous material such as porous metal and porous resin. The porous member 52 has an upper end surface 52*b* from which a projection 52*c* projects upward. A periphery of the porous member 52 is formed into a disk-like shape which is in contact with an inner side surface of the container 1. The porous member 52 is formed at its central portion with a through hole. An outer periphery of the projection 7*b* of the upper bearing member 7 can be fitted into the through hole, and the through hole intersects with upper and lower end surfaces made of porous material. The porous member 52 is fitted over the projection 7*b* such that the lower end surface 52*a* and the upper bearing member 7 comes into tight contact with each other, and the porous member 52 defines the lower space 17 of the rotational motor and the compression mechanism from each other.

Further, the projection 52*c* of the upper end surface 52*b* of the porous member 52 is cylindrical in shape, and an outer diameter of the projection 52*c* is slightly smaller than an inner diameter of the inner side surface of the coil end 11*c*, and a small gap is provided so that the projection 52*c* does not come into contact with the lower end surface 12*a* of the rotor 12 and a balancer weight 12*d*. The periphery of the porous member 52 is in contact with the inner side surface of the container 1.

The operation of the rotary compressor having the above-described structure will be explained based on the flow of the working fluid and the oil.

Working fluid which was compressed by the compression mechanism and injected into the lower space 17 from the discharge hole 7*a* directly flows into the porous member 52 because the lower end surface 52*a* of the porous member 52 is in tight contact with the upper bearing member 7. At that time, since the flow speed of the working fluid is reduced by the passage resistance in the porous member 52, oil drops included in the working fluid are separated from the working fluid in the porous member 52 and returns into the oil reservoir 16.

The working fluid which passed through the porous member 52 flows into the lower space 17. Since the projection 52*c* of the porous member 52 is accommodated inside the coil end 11*c*, the turning flow of the working fluid becomes weak by the influence of the rotation of the rotor 12. A portion of the oil drops included in the working fluid attaches to the inner wall of the container 1 by the centrifugal force of the turning flow or falls due to the gravity and is separated from the working fluid and returns into the oil reservoir 16 along the inner wall of the container 1.

Thereafter, the working fluid passes through the notches 11*e* or gap 18 from the lower space 17 and flows into the upper space 19. Working fluid which flowed into the upper space 19 from the notches 11*e* flows toward the discharge pipe 15. At that time, a portion of the working fluid passes in the vicinity of the upper end surface 12*b* of the rotor 12 and causes turning flow by the influence of the rotation of the rotor 12. Working fluid which flowed into the upper space 19 through the gap 18 also flows toward the discharge pipe 15. At that time, the working fluid causes the turning flow by the influence of the rotation of the rotor 12.

On the other hand, a portion of the oil drops included in the working fluid attaches to the inner wall of the container 1 by the centrifugal force of the turning flow or falls due to the gravity and are separated from the working fluid and returns into the oil reservoir 16. The working fluid is discharged from the discharge pipe 15.

With the above structure, turning flow generated in the lower space 17 by the rotation of the rotor 12 is not transmitted to the porous member 52. Further, the porous member 52 is fixed to an element other than the rotor 12 and the shaft 2 and the porous member 52 does not rotate. Therefore, turning flow caused by the porous member 52 is not generated.

Therefore, according to the rotary compressor of the embodiment, the working fluid is compressed by the compression mechanism and discharged into the porous member 52 from the discharge hole 7*a* of the upper bearing member 7 through the lower end surface 52*a*. The flow speed of the working fluid is not increased by the turning flow, and ability of the working fluid to transport the oil drops of the refrigeration oil is lowered as compared with the conventional compressor. Thus, the oil separating effect by the density difference between the working fluid and refrigeration oil in the porous member 52 is enhanced. Since the oil drops of the refrigeration oil are not divided finely by the turning flow, the oil separating effect by the density difference between the working fluid and the refrigeration oil is further enhanced.

The working fluid passes through the porous member 52 and moves into the lower space 17. At that time, since the passage resistance in the porous member 52 is high, the flow speed of the working fluid is largely reduced. The thickness of the central portion of the porous member 52 is increased due to the projection 52*c*, the resistance of the working fluid when it passes through the central portion is greater than that of the working fluid passing through the periphery. Therefore, the working fluid discharged to the central area of the porous member 52 is dispersed from the central portion toward the periphery, and flows toward the lower space 17 and thus, the flow speed of the working fluid passing through the porous member 52 is further reduced. Since the flow speed of the working fluid in the porous member 52 is reduced, the ability of the working fluid to transport the refrigeration oil is reduced, the oil separating effect by the density difference between the working fluid and the refrigeration oil is enhanced and thus, refrigeration oil included in the working fluid discharged from the discharge hole 7*a* of the upper bearing member 7 is separated from the working fluid in the porous member 52.

The porous member 52 has a wide surface area which comes into contact with the working fluid and the refrigeration oil passing through the porous member 52. Thus, the oil drops of the refrigeration oil are prone to attach to the porous member 52 and grow, and since the oil drops falls downward of the porous member 52 by the density difference, the oil separating effect is enhanced.

As described above, since the porous member 52 is disposed, the oil separating effect in the porous member 52 is enhanced, working fluid from which most of the oil drops are separated flows into the lower space 17 where stirring effect is generated by the turning flow and the rotation of the asperities such as the balancer weight 12*d* of the lower end surface 12*a* of the rotor 12. Thus, it is possible to minimize the possibility that the oil separating effect becomes difficult due to the turning flow and the stirring effect in the lower space 17, and the mass of the refrigeration oil included in the working fluid discharged from the discharge pipe 15 is reduced.

The second embodiment is different from the first embodiment in that the directions of the porous members 51 and 52 are different on the side of the lower end surface 51*a* and on the side of the upper end surface 52*b*, and in the second embodiment, the lower end surface 52*a* is in tight contact with the upper bearing member 7, the porous member 52 is fitted over the projection 7*b* of the upper bearing member 7, the porous member 52 made of porous metal or porous resin defines the space, the porous member 52 is of the plate-like shape, the porous member 52 is made of a non-magnetic material, the porous member 52 is made of insulative material such as resin and ceramic, and the surface of the porous member 52 is lipophobic, and the same effects as those of the first embodiment can be obtained.

Third Embodiment

A compressor of a third embodiment of the present invention is similar to the rotary compressor of the first embodiment explained using FIG. 1. The same elements are designated with the same symbols. Explanation of the same structure and operation will be omitted.

Figure 4:
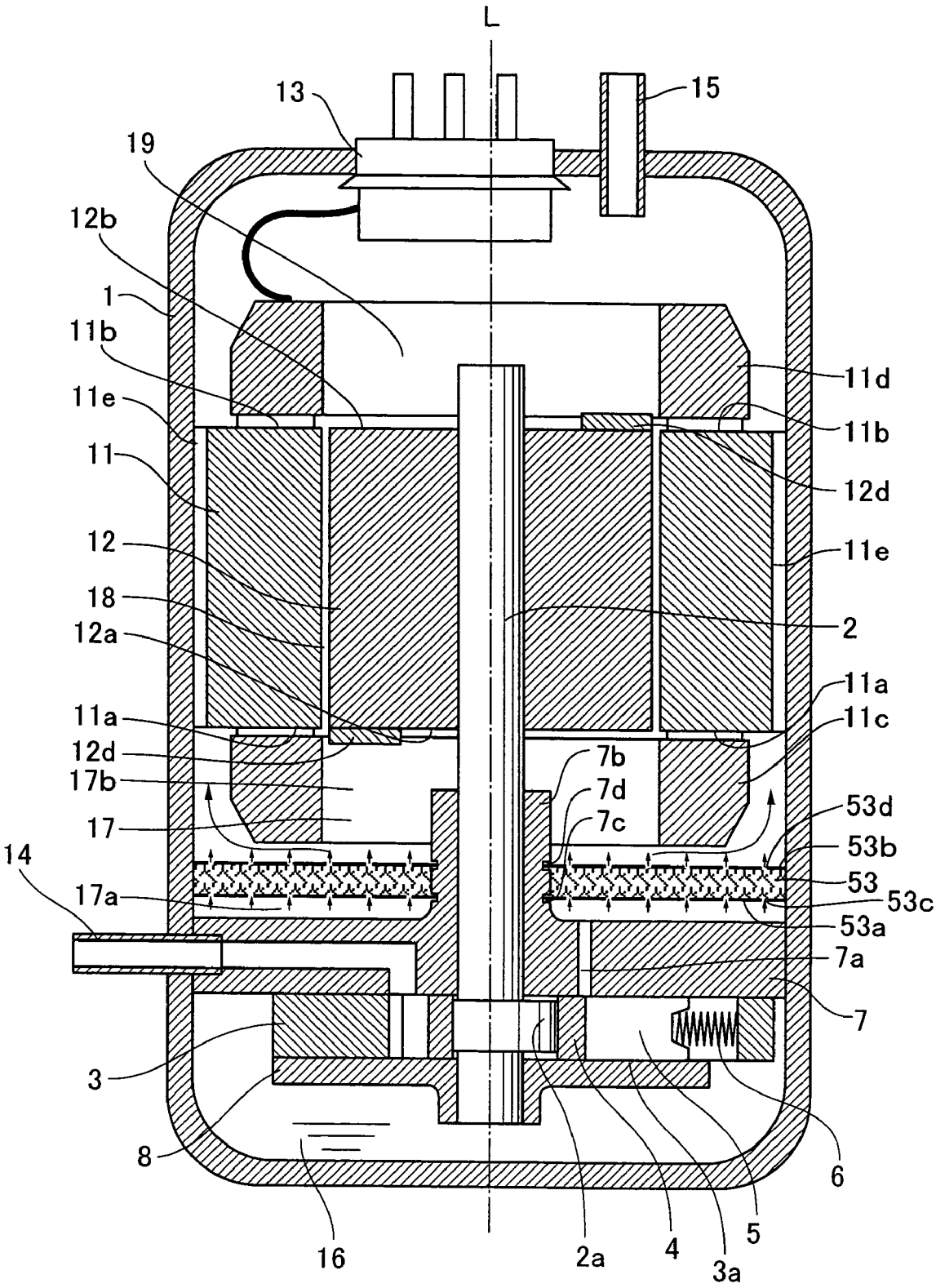
FIG. 4 is a vertical sectional view of a rotary compressor according to a third embodiment of the invention.

FIG. 4 is a vertical sectional view of the rotary compressor according to the third embodiment of the invention.

The rotary compressor of this embodiment is different from the conventional rotary compressor shown in FIG. 8 in that a porous member 53 is provided in the lower space 17 of the rotational motor. That is, a mesh made of metal thin wire, glass wool, ceramic wool or the like is used as the porous member 53 provided in the lower space 17. Two annular ring grooves 7*c* and 7*d* are provided on the outer periphery of the projection 7*b* of the upper bearing member 7, the plate members 53*a* and 53*b* are provided at their central portions with through holes which can be fitted to the ring grooves 7*c* and 7*d*, and the plate members 53*a* and 53*b* are fitted and fixed to the ring grooves 7*c* and 7*d*. The plate members 53*a* and 53*b* pinch and fix the porous member 53, and the lower space 17 of the rotational motor is defined into the lower compression mechanism-side space 17*a* on the side of the compression mechanism and the lower rotational motor-side space 17*b* on the side of the rotational motor.

The plate members 53*a* and 53*b* are disk-like in shape made of resin or ceramic. The plate members 53*a* and 53*b* have a plurality of openings 53*c* and 53*d* in addition to the through hole formed in the central portions. The density of the porous member 53 is increased toward its central portion, and is pinched between the plate members 53*a* and 53*b*. The porous member 53 may have a combination of mesh and plate members 53*a* and 53*b*.

The operation of the rotary compressor having the above-described structure will be explained based on the flow of the working fluid and the oil.

The working fluid which is compressed by the compression mechanism and injected from the discharge hole 7*a* into the lower space 17 is first stays in the lower compression mechanism-side space 17*a* defined by the porous member 53 and where the working fluid is not affected by the rotation of the rotor 12. While the working fluid stays in the lower compression mechanism-side space 17*a*, a portion of the oil drops included in the working fluid attaches to the inner wall of the container 1 or falls due to the gravity downward and is separated from the working fluid and returns into the oil reservoir 16.

Then, the working fluid passes through the porous member 53. At that time, since the flow speed of the working fluid is reduced, the oil drops are separated from the working fluid in the porous member 53.

The working fluid which passed through the porous member 53 flows into the lower rotational motor-side space 17*b*, and generates the turning flow due to influence of the rotation of the rotor 12. A portion of the oil drops included in the working fluid attaches to the inner wall of the container 1 by the centrifugal force of the turning flow or falls due to the gravity and is separated from the working fluid and returns into the oil reservoir 16.

Further, the working fluid passes through the notches 11*e* and the gap 18 from the lower rotational motor-side space 17*b*, and flows into the upper space 19 of the rotational motor. Working fluid which flowed into the upper space 19 from the notches 11*e* flows toward the discharge pipe 15. At that time, a portion of the working fluid passes in the vicinity of the upper end surface 12*b* of the rotor 12 and causes turning flow by the influence of the rotation of the rotor 12. Working fluid which flowed into the upper space 19 through the gap 18 also flows toward the discharge pipe 15. At that time, the working fluid causes the turning flow by the influence of the rotation of the rotor 12.

A portion of the oil drops included in the working fluid attaches to the inner wall of the container 1 by the centrifugal force of the turning flow or falls due to the gravity and is separated from the working fluid and returns into the oil reservoir 16 along the inner wall of the container 1 or the wall surface of the stator 11. Then, the working fluid is discharged from the discharge pipe 15.

With the above structure, since the lower compression mechanism-side space 17*a* is defined from the lower rotational motor-side space 17*b* by the plate members 53*a* and 53*b* and the porous member 53, the turning flow generated in the lower rotational motor-side space 17*b* by the rotation of the rotor 12 is not transmitted to the lower compression mechanism-side space 17*a*. The plate members 53*a* and 53*b* are fixed to elements other than the rotor 12 and the shaft 2 and are not rotated. Thus, the turning flow caused by the plate members 53*a* and 53*b* and the porous member 53 in the lower compression mechanism-side space 17*a* is not generated.

Therefore, according to the rotary compressor of the embodiment, the working fluid is compressed by the compression mechanism and discharged into the lower compression mechanism-side space 17*a* from the discharge hole 7*a* of the upper bearing member 7. The flow speed of the working fluid is not increased, and ability of the working fluid to transport the oil drops of the refrigeration oil is lowered as compared with the conventional compressor. Thus, the oil separating effect by the density difference between the working fluid and refrigeration oil in the lower compression mechanism-side space 17*a* is enhanced. Since the oil drops of the refrigeration oil are not divided finely by the turning flow, the oil separating effect by the density difference between the working fluid and the refrigeration oil is further enhanced.

The working fluid passes through the porous member 53 and moves from the lower compression mechanism-side space 17*a* to the lower rotational motor-side space 17*b*. At that time, since the passage resistance in the porous member 53 is great, the flow speed of the working fluid is further reduced. The porous member 53 is pinched between the plate members 53*a* and 53*b* such that the density of the central portion of the porous member 53 is higher. Thus, the resistance of the working fluid passing through the central portion of the porous member 53 is higher than that of the working fluid passing through the periphery.

Therefore, of the working fluid which is discharged from the discharge hole 7*a* of the upper bearing member 7 and which collides against the central portion of the plate member 53*a*, an amount of working fluid which passes through the central portion of the plate member 53*a* is reduced, and an amount of working fluid which is once dispersed in the lower compression mechanism-side space 17*a* and then passes through the periphery of the plate member 53*a* is increased, and the flow speed of the working fluid which passes through the porous member 53 is further reduced. Thus, the flow speed of the working fluid in the porous member 53 is reduced, the ability of working fluid to transport the refrigeration oil is deteriorated, and when the fine oil drops which can not be separated from the working fluid in the lower compression mechanism-side space 17*a* pass through the porous member 53, the oil drops are easily separated from the working fluid by the density difference between the working fluid and the refrigeration oil.

The porous member 53 has a wide surface area which comes into contact with the working fluid and the refrigeration oil passing through the porous member 53. Thus, the oil drops of the refrigeration oil are prone to attach to the porous member 53 and grow, and since the oil drops falls downward of the porous member 53 and the plate member 53*a* by the density difference, the oil separating effect is enhanced.

As described above, since the plate members 53*a* and 53*b* and the porous member 53 are disposed, the oil separating effect in lower compression mechanism-side space 17*a* is enhanced, working fluid from which most of the oil drops are separated flows into the lower rotational motor-side space 17*b* where stirring effect is generated by the turning flow and the rotation of the asperities such as the balancer weight 12*d* of the lower end surface 12*a* of the rotor 12. Thus, it is possible to minimize the possibility that the oil separating effect becomes difficult due to the turning flow and the stirring effect in the lower rotational motor-side space 17*b*, and the mass of the refrigeration oil included in the working fluid discharged from the discharge pipe 15 is reduced.

Further, the porous member 53 is pinched between the plate members 53*a* and 53*b*, the porous member 53 is not deformed by the flow of the working fluid and the porous member 53 is not deviated from the position when it is produced. Therefore, the refrigeration oil separating ability when the compressor is produced can be maintained. Since there is no fear that the compressor is not damaged by the contact with the rotational motor, the reliability is not deteriorated.

Since the plate members 53*a* and 53*b* are fixed to the upper bearing member 7 which supports the shaft 2, it is easy to position the porous member in the direction along the center axis L in the space between the rotational motor and the compression mechanism, and especially since the positioning member such as a spacer is unnecessary, the compressor can be produced inexpensively.

Since the plate members 53*a* and 53*b* are fitted and fixed to the ring grooves 7*c* and 7*d*, the compressor can be assembled without using fixing parts such as a bolt, and the compressor can be produced inexpensively.

Since the porous member 53 made of metal thin wire (i.e., metal mesh), glass wool, ceramic wool or the like defines the space, even if size in the radial direction between the outer peripheral surface of the projection 7*b* and the inner side surface of the container 1 is varied, the size variation can be absorbed and thus, the lower space 17 can easily be defined. It is easy to form the porous member 53 such that the central portion thereof has higher density.

The porous member 53 is of plate-like in shape, the surface of the plate member 53*b* which comes into contact with the turning flow generated in the lower rotational motor-side space 17*b* is flat. Therefore, turbulence caused by peel of the turning flow is not easily generated on the surface of the plate member 53*b*. Thus, the efficiency of the compressor is not deteriorated by loss of kinetic energy caused by turbulent flow.

If the plate members 53*a* and 53*b* and the porous member 53 are made of non-magnetic material, the influence acting on the magnetic circuit of the rotational motor is small, and the oil separating efficiency can be enhanced without deteriorating the efficiency of the rotational motor.

Since the plate members 53*a* and 53*b* and the porous member 53 are made of insulative material such as resin and ceramic, the plate member 53*b* can be disposed in contact with the coil end 11*c* of the stator 11. Thus, it is unnecessary to provide a gap between the coil end 11*c* and the plate member 53*b* to take the electrical insulation performance into consideration. Thus, it is unnecessary to increase the compressor in size so as to secure the gap between the coil end 11*c* and the porous member 53, and the embodiment can be realized in the container 1 having the same size as that of the conventional container.

It is preferable that the surface of the porous member 53 is lipophobic. If the surface of the porous member 53 is lipophobic, the refrigeration oil is not easily held on the surface of the porous member 53. Thus, the refrigeration oil attaches the porous member 53 and a particle diameter of the refrigeration oil is increased, and the refrigeration oil is prone to fall downward of the porous member 53 by the density difference. Therefore, refrigeration oil separated from the working fluid can easily return to the oil reservoir 16.

The vertical rotary compressor is explained in this embodiment, but if working fluid discharged from the compression mechanism passes in the vicinity of the rotor 12 until the working fluid is discharged from the discharge pipe 15 provided in the container 1 irrespective of the difference between the vertical type and the lateral type, or irrespective of the difference of compressing manners, the same effect can be obtained.

In a compressor in which the working fluid injected from the discharge hole 7*a* collides directly against the lower end surface 12*a* of the rotor 12 like the conventional rotary compressor, the effect for defining the lower space 17 by the porous member 53 is exhibited more remarkably.

Fourth Embodiment

A compressor of a fourth embodiment of the present invention is similar to the rotary compressor of the first embodiment and the conventional rotary compressor. The same elements are designated with the same symbols. Explanation of the same structure and operation will be omitted.

Figure 5:
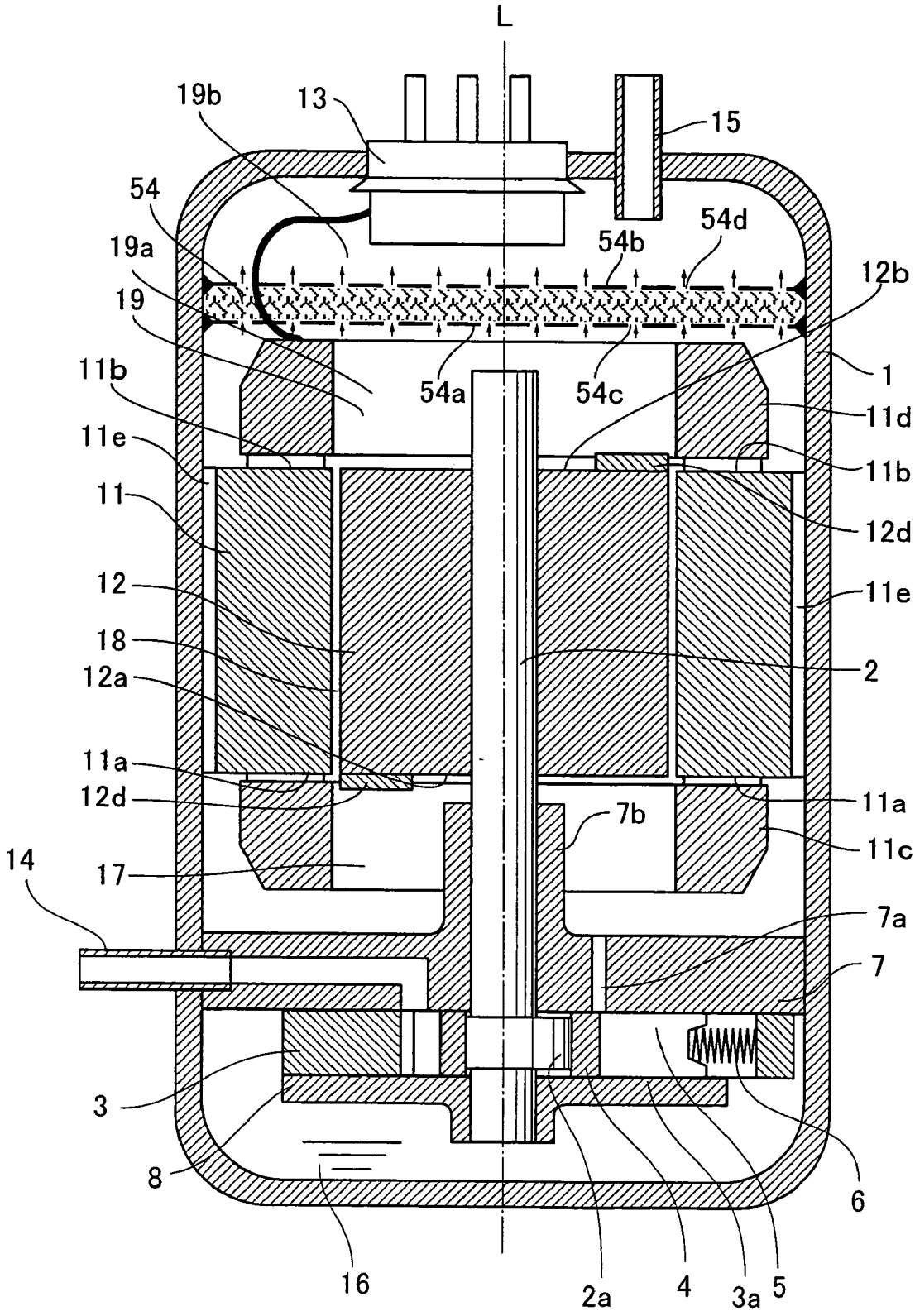
FIG. 5 is a vertical sectional view of a rotary compressor according to a fourth embodiment of the invention.

FIG. 5 is a vertical sectional view of a rotary compressor according to the fourth embodiment of the invention.

The rotary compressor of this embodiment is different from the conventional rotary compressor shown in FIG. 8 in that a porous member 54 is provided in the upper space 19 of the rotational motor. That is, a mesh made of metal thin wire, glass wool, ceramic wool or the like is used as the porous member 54 provided in the upper space 19. In the upper space 19 of the rotational motor, two plate members 54*a* and 54*b* are fixed to the inner side surface of the container 1 such that the plate members 54*a* and 54*b* become substantially vertical surfaces with respect to the center axial L. The plate members 54*a* and 54*b* pinch and fix the porous member 54 so that the upper space 19 of the rotational motor is defined into an upper rotational motor-side space 19*a* on the side of the rotational motor and an upper discharge pipe-side space 19*b* on the side of the discharge pipe 15.

The plate members 54*a* and 54*b* are of disk-like shape made of resin or ceramic, and include a plurality of openings 54*c* and 54*d*. The porous member 54 may have a combination of a mesh and the plate members 54*a* and 54*b*.

The operation of the rotary compressor having the above-described structure will be explained based on the flow of the working fluid and the oil.

Working fluid compressed by the compression mechanism and injected into the lower space 17 from the discharge hole 7*a* generates the turning flow by the influence of the rotation of the rotor 12. A portion of the oil drops included in the working fluid attaches to the inner wall of the container 1 by the centrifugal force of the turning flow or falls due to the gravity and is separated from the working fluid and returns into the oil reservoir 16. Then, the working fluid passes through the notches 11*e* and the gap 18 from the lower space 17, and flows into the upper space 19 which is the flowing place of the working fluid between the rotational motor and the discharge pipe 15.

The working fluid which flowed into the upper space 19 generates the turning flow by the influence of the rotation of the rotor 12 in the upper rotational motor-side space 19*a* defined by the porous member 54. A portion of the oil drops included in the working fluid attaches to the inner wall of the container 1 by the centrifugal force of the turning flow or falls due to the gravity and is separated from the working fluid and returns into the oil reservoir 16 along the inner wall of the container 1 or the wall surface of the stator 11.

Then, the working fluid passes through the porous member 54. At that time, since the flow speed of the working fluid is reduced, the oil drops are separated from the working fluid in the porous member 54.

The working fluid which passed through the porous member 54 flows into the upper discharge pipe-side space 19*b* defined by the porous member 54 and where the working fluid is not affected by the rotation of the rotor 12 and stays in the upper discharge pipe-side space 19*b*. While the working fluid stays in the upper discharge pipe-side space 19*b*, a portion of the oil drops included in the working fluid attaches to the inner wall of the container 1 or falls due to the gravity and returns into the oil reservoir 16 along the inner wall of the container 1. Then, the working fluid is discharged from the discharge pipe 15.

With the above structure, since the passage resistance in the porous member 54 is great, the turning flow generated in the upper rotational motor-side space 19*a* by the rotation of the rotor 12 does not affect the flow of the working fluid in the porous member 54 almost at all. Thus, the flow speed of the working fluid in the porous member 54 is reduced. The working fluid passes through the porous member 54 and moves from the upper rotational motor-side space 19*a* to the upper discharge pipe-side space 19*b*. At that time, since the passage resistance in the porous member 54 is great, the flow speed of the working fluid is largely reduced. For this reason, the flow speed of the working fluid in the porous member 54 is reduced and thus, the ability of the working fluid to transport the refrigeration oil is also reduced, and when the fine oil drops which could not be separated from the working fluid in the upper rotational motor-side space 19*a* are easily separated from the working fluid by the density difference between the working fluid and the refrigeration oil when the working fluid passes through the porous member 54.

The porous member 54 has a wide surface area which comes into contact with the working fluid and the refrigeration oil passing through the porous member 54. Thus, the oil drops of the refrigeration oil are prone to attach to the porous member 54 and grow, and since the oil drops falls downward of the porous member 54 and the plate member 54*a* by the density difference, the oil separating effect is enhanced.

Since the upper discharge pipe-side space 19*b* is defined from the upper rotational motor-side space 19*a* by the plate members 54*a* and 54*b* and the porous member 54, the turning flow generated in the upper rotational motor-side space 19*a* by the rotation of the rotor 12 is not transmitted to the upper discharge pipe-side space 19*b*. The plate members 54*a* and 54*b* are fixed to elements other than the rotor 12 and the shaft 2 and are not rotated. Thus, the turning flow caused by the plate members 54*a* and 54*b* and the porous member 54 in the upper discharge pipe-side space 19*b* is not generated.

Therefore, in the rotary compressor of the embodiment, the working fluid passes through the porous member 54*a*, the porous member 54 and the porous member 54*b* and flows into the upper discharge pipe-side space 19*b*. The flow speed of the working fluid is not increased by the turning flow, and the ability of the working fluid to transport the oil drops of the refrigeration oil is lowered as compared with the conventional compressor. Thus, the oil separating effect by the density difference between the working fluid and the refrigeration oil in the upper discharge pipe-side space 19*b* is enhanced. Further, since the oil drops of the refrigeration oil are not finely divided, the oil separating effect by the density difference between the working fluid and the refrigeration oil is further enhanced.

Oil drops are largely separated from the working fluid which passed through the plate members 54*a* and 54*b* and the porous member 54 from the upper rotational motor-side space 19*a* and flowed into the upper discharge pipe-side space 19*b*, and the turning flow is not transmitted to the upper discharge pipe-side space 19*b*. Thus, the oil separating effect is enhanced in the upper discharge pipe-side space 19*b*, and the mass of the refrigeration oil included in the working fluid discharged from the discharge pipe 15 is reduced.

Further, the porous member 54 is pinched between the plate members 54*a* and 54*b*, the porous member 54 is not deformed by the flow of the working fluid and the porous member 54 is not deviated from the position when it is produced. Therefore, the refrigeration oil separating ability when the compressor is produced can be maintained. Since there is no fear that the compressor is not damaged by the contact with the rotational motor, the reliability is not deteriorated.

Since the plate members 54*a* and 54*b* are fixed to the inner side surface of the container 1 it is easy to position the porous member in the direction along the center axis L in the space between the rotational motor and the discharge pipe, and especially since the positioning member such as a spacer is unnecessary, the compressor can be produced inexpensively.

Since the porous member 54 made of metal thin wire, glass wool, ceramic wool or the like defines the space, even if inner diameter size of the container 1 is varied, the size variation can be absorbed and thus, the upper space 19 can easily be defined.

Since the porous member 54*a* is of plate-like shape, the surface of the plate member 54*a* which comes into contact with the turning flow generated in the upper rotational motor-side space 19*a* is flat. Therefore, turbulence caused by peel of the turning flow is not easily generated on the surface of the porous member 54*a*. Thus, the efficiency of the compressor is not deteriorated by loss of kinetic energy caused by turbulent flow.

If the plate members 54*a* and 54*b* and the porous member 54 are made of non-magnetic material, the influence acting on the magnetic circuit of the rotational motor is small, and the oil separating efficiency can be enhanced without deteriorating the efficiency of the rotational motor.

Since the plate members 54*a* and 54*b* are made of insulative material such as resin and ceramic and the porous member 54 is made of insulative glass wool, ceramic wool or the like, the plate member 54*b* can be disposed in contact with the coil end 11*c* of the stator 11. Thus, it is unnecessary to provide a gap between the coil end 11*c* and the plate member to take the electrical insulation performance into consideration. Thus, it is unnecessary to increase the compressor in size so as to secure the gap between the coil end 11*c* and the porous member, and the embodiment can be realized in the container 1 having the same size as that of the conventional container.

It is preferable that the surface of the porous member 54 is lipophobic. If the surface of the porous member 54 is lipophobic, the refrigeration oil is not easily held on the surface of the porous member 54. Thus, the refrigeration oil attaches the porous member 54 and a particle diameter of the refrigeration oil is increased, and the refrigeration oil is prone to fall downward of the porous member 54 by the density difference. Therefore, refrigeration oil separated from the working fluid can easily return to the oil reservoir 16.

The vertical rotary compressor is explained in this embodiment, but if most of working fluid discharged from the compression mechanism passes in the vicinity of the rotor 12 until the working fluid is discharged from the discharge pipe 15 provided in the container 1 irrespective of the difference between the vertical type and the lateral type and irrespective of the difference of compressing manner, the same effect can be obtained.

Fifth Embodiment

A compressor of a fourth embodiment of the present invention is similar to the rotary compressor of the first embodiment and the conventional rotary compressor. The same elements are designated with the same symbols. Explanation of the same structure and operation will be omitted.

Figure 6:
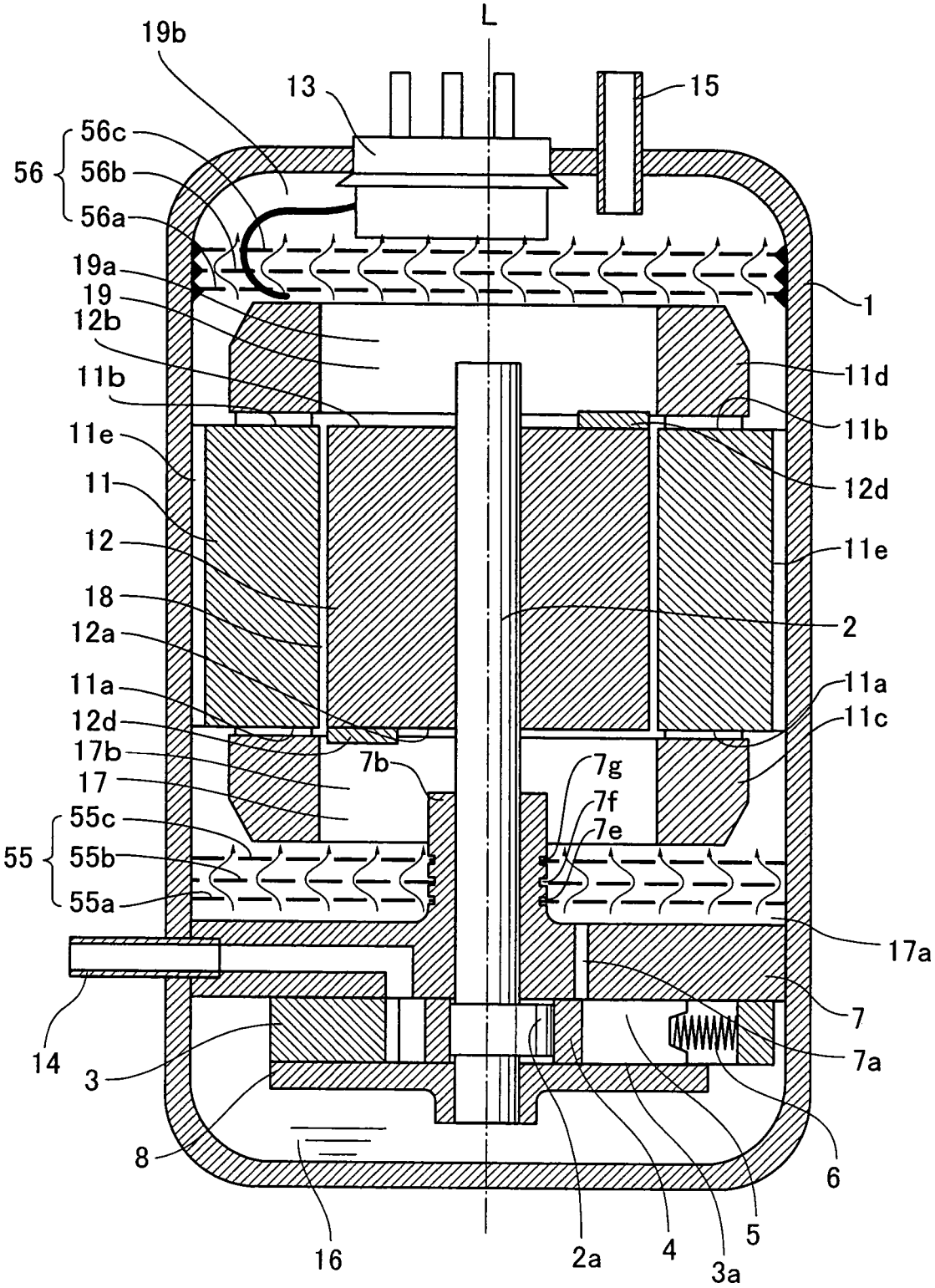
FIG. 6 is a vertical sectional view of a rotary compressor according to a fifth embodiment of the invention.

FIG. 6 is a vertical sectional view of the rotary compressor according to the fifth embodiment of the invention.

The rotary compressor of this embodiment is different from the conventional rotary compressor shown in FIG. 8 in that the lower space 17 and the upper space 19 of the rotational motor are provided with porous members 55 and 56, respectively. That is, disk-like porous plate 55*a*, 55*b*, 55*c*, 56*a*, 56*b* and 56*c* comprising honeycomb or punching metal made of resin or ceramic are used as the porous members 55 and 56 provided on the lower space 17 and the upper space 19. An outer periphery of the projection 7*b* of the upper bearing member 7 are provided with three annular ring groove 7*e*, 7*f* and 7*g* from a lower position of the outer periphery in this order. The disk-like porous plates 55*a*, 55*b*, 55*c* are provided at their central portions with through holes which can be fitted to the ring grooves. The porous plates 55*a*, 55*b*, 55*c* are fitted and fix to the ring groove 7*e*, 7*f* and 7*g*. Of the porous members 55 and 56, the porous member 55 comprising the porous plates 55*a*, 55*b*, 55*c* defines the lower space 17 of the rotational motor into the lower compression mechanism-side space 17*a* on the side of the compression mechanism and the lower rotational motor-side space 17*b* on the side of the rotational motor.

In the upper space 19, the porous plates 56*a*, 56*b* and 56*c* are fixed to the inner side surface of the container 1 from a lower portion in the upper space 19 in this order, and the other porous member 56 comprising the porous plates 56*a*, 56*b* and 56*c* defines the upper space 19 of the rotational motor into the upper rotational motor-side space 19*a* on the side of the rotational motor and the upper discharge pipe-side space 19*b* on the side of the discharge pipe 15.

The porous plate 55*a*, 55*b*, 55*c*, 56*a*, 56*b* and 56*c* are disposed such that they are substantially perpendicular to the center axis L. The porous plate 55*a*, 55*b*, 55*c*, 56*a*, 56*b* and 56*c* has a plurality of small holes. The positions of the small holes are different among the respective porous plates. The small holes closer to the central portion have smaller diameters.

Although the porous member 55 comprises three porous plates 55*a*, 55*b*, 55*c* which are laminated on one another in this embodiment, the porous member 55 may comprise at least one porous plate 55*a*. Similarly, the porous member 56 may comprise the three porous plates 56*a*, 56*b* and 56*c* to one porous plate 56*a*. In the following explanation, the porous plates 55*a*, 55*b*, 55*c* may be called a porous member 55, and the porous plates 56*a*, 56*b* and 56*c* may be called a porous member 56.

The operation of the rotary compressor having the above-described structure will be explained based on the flow of the working fluid and the oil.

The working fluid which is compressed by the compression mechanism and injected from the discharge hole 7*a* into the lower space 17 first stays in the lower compression mechanism-side space 17*a* defined by the porous member 55 and where the working fluid is not affected by the rotation of the rotor 12. While the working fluid stays in the lower compression mechanism-side space 17*a*, a portion of the oil drops included in the working fluid attaches to the inner wall of the container 1 or falls due to the gravity downward and is separated from the working fluid and returns into the oil reservoir 16.

Thereafter, the working fluid passes through the porous member 55. At that time, the flow speed of the working fluid is reduced and thus, the oil drops are separated from the working fluid in the porous member 55. The working fluid which passed through the porous member 55 flows into the lower rotational motor-side space 17*b* and generates the turning flow by the influence of the rotation of the rotor 12. A portion of the oil drops included in the working fluid attaches to the inner wall of the container 1 by the centrifugal force of the turning flow or falls due to the gravity and is separated from the working fluid and returns into the oil reservoir 16.

Further, the working fluid passes through the notches 11*e* and the gap 18 from the lower rotational motor-side space 17*b*, and flows into the upper space 19 of the rotational motor. The working fluid which flowed into the upper space 19 generates the turning flow by the influence of the rotation of the rotor 12 in the upper rotational motor-side space 19*a* defined by the porous member 56. A portion of the oil drops included in the working fluid attaches to the inner wall of the container 1 by the centrifugal force of the turning flow or falls due to the gravity and is separated from the working fluid and returns into the oil reservoir 16 along the inner wall of the container 1 or the wall surface of the stator 11.

Thereafter, the working fluid passes through the porous member 56. At that time, the flow speed of the working fluid is reduced and thus, the oil drops are separated from the working fluid in the porous member 56. The working fluid which passed through the porous member 56 flows into the upper discharge pipe-side space 19*b* defined by the porous member 56 and where the working fluid is not affected by the rotation of the rotor 12 and stays. While the working fluid stays in the upper discharge pipe-side space 19*b*, a portion of the oil drops included in the working fluid attaches to the inner wall of the container 1 or falls due to the gravity downward and is separated from the working fluid and returns into the oil reservoir 16 along the inner wall of the container 1 or the like. Then, the working fluid is discharged from the discharge pipe 15.

With the above structure, since the lower compression mechanism-side space 17*a* is defined from the lower rotational motor-side space 17*b* by the porous plates 55*a*, 55*b*, 55*c*, the turning flow generated in the lower rotational motor-side space 17*b* by the rotation of the rotor 12 is not transmitted to the lower compression mechanism-side space 17*a*. Further, the porous plates 55*a*, 55*b*, 55*c* are fixed to elements other than the rotor 12 and the shaft 2 and are not rotated. Thus, the turning flow caused by the porous plates 55*a*, 55*b*, 55*c* in the lower compression mechanism-side space 17*a* is not generated.

Therefore, in the rotary compressor of the embodiment, the flow speed of the working fluid compressed in the compression mechanism and discharged from the discharge hole 7*a* of the upper bearing member 7 into the lower compression mechanism-side space 17*a* is not increased by the turning flow, and the ability of the working fluid to transport the oil drops of the refrigeration oil is lowered as compared with the conventional compressor. Thus, the oil separating effect by the density difference between the working fluid and the refrigeration oil in the lower compression mechanism-side space 17*a* is enhanced. Further, since the oil drops of the refrigeration oil are not finely divided by the turning flow, the oil separating effect by the density difference between the working fluid and the refrigeration oil is further enhanced.

The working fluid passes through the porous plates 55*a*, 55*b*, 55*c* and moves from the lower compression mechanism-side space 17*a* to the lower rotational motor-side space 17*b*. At that time, since the passage resistances at the inlets, hole walls and outlets of the small holes of the porous plates 55*a*, 55*b*, 55*c* are high, the flow speed of the working fluid is further reduced. Since the diameters of the small holes of the porous plates 55*a*, 55*b*, 55*c* closer to the central portions of the plates are smaller, resistance of the working fluid passing through the central portion is greater than that of the working fluid passing through the periphery.

Thus, of the working fluid which is discharged from the discharge hole 7*a* of the upper bearing member 7 and collides against the central area of the porous plate 55*a*, an amount of working fluid passing through the small holes of the central portions of the porous plate 55*a* is reduced, an amount of working fluid which is once dispersed in the lower compression mechanism-side space 17*a* and passes through the small holes of the peripheries of the porous plates 55*a*, 55*b*, 55*c* is increased, and the flow speed of the working fluid passing through the porous plates 55*a*, 55*b*, 55*c* is further reduced. Therefore, the speed of the working fluid in the porous plates 55*a*, 55*b*, 55*c* is reduced and the ability of the working fluid to transport the refrigeration oil is reduced, and when the working fluid passes through the porous plates 55*a*, 55*b*, 55*c*, the fine oil drops which can not be separated from the working fluid in the lower compression mechanism-side space 17*a* are easily separated from the working fluid by the density difference between the working fluid and the refrigeration oil.

The porous plates 55*a*, 55*b*, 55*c* are provided with the plurality of small holes, and the positions of the small holes in the porous plates are different from each other. Therefore, the working fluid and refrigeration oil passing through the small holes of the porous plate 55*a* collide against the porous plate 55*b*, working fluid and refrigeration oil passing through the small holes of the porous plate 55*b* collide against the porous plate 55*c*. Thus, the working fluid and refrigeration oil easily come into contact with the surface of the porous plate. Hence, the oil drops of the refrigeration oil attach to the porous plates 55*a*, 55*b*, 55*c* and grow and fall downward of the porous plate 55*a*, and the oil separating effect is enhanced.

As described above, since the porous plates 55*a*, 55*b*, 55*c* are provided, the oil separating effect in the lower compression mechanism-side space 17*a* is enhanced, and working fluid from which most of oil drops are separated flows into the lower rotational motor-side space 17*b* where stirring effect is generated by the turning flow and rotation of the asperities such as the balancer weight 12*d* of the lower end surface 12*a* of the rotor 12. Thus, it is possible to minimize the possibility that the oil separating effect becomes difficult due to the turning flow and the stirring effect in the lower rotational motor-side space 17*b*, and the working fluid passes through the notches 11*e* of the stator 11 and the gap 18 between the stator 11 and the rotor 12 and is discharged into the upper rotational motor-side space 19*a*.

In the upper space 19, the porous plates 56*a*, 56*b* and 56*c* re fixed to the container 1 substantially perpendicularly to the center axis L. Turning flow generated by the rotation of the rotor 12 in the upper rotational motor-side space 19*a* is less prone to be transmitted beyond the porous plates 56*a*, 56*b* and 56*c*. The working fluid passes through the porous plates 56*a*, 56*b*, 56*c* and moves from the upper rotational motor-side space 19*a* to the upper discharge pipe-side space 19*b*. At that time, since the passage resistances at the inlets, hole walls and outlets of the small holes of the porous plates 56*a*, 56*b*, 56*c* are high, the flow speed of the working fluid is largely reduced in the porous plates 56*a*, 56*b* and 56*c*. Since the flow speed of the working fluid is reduced, the ability of the working fluid to transport the refrigeration oil is reduced, and when the working fluid passes through the porous plates 56*a*, 56*b*, 56*c*, the fine oil drops which can not be separated from the working fluid in the upper rotational motor-side space 19*a* are easily separated from the working fluid by the density difference between the working fluid and the refrigeration oil.

The porous plates 56*a*, 56*b*, 56*c* are provided with the plurality of small holes, and the positions of the small holes in the porous plates are different from each other. Therefore, the working fluid and refrigeration oil passing through the small holes of the porous plate 56*a* collide against the porous plate 56*b*, working fluid and refrigeration oil passing through the small holes of the porous plate 56*b* collide against the porous plate 56*c*. Thus, the working fluid and refrigeration oil easily come into contact with the surface of the porous plate. Hence, the oil drops of the refrigeration oil attach to the porous plates 56*a*, 56*b* and 56*c* and grow and fall downward of the porous plate 56*a*, and the oil separating effect is enhanced.

Since the upper discharge pipe-side space 19*b* is defined from the upper rotational motor-side space 19*a* by the porous plates 56*a*, 56*b*, 56*c*, the turning flow generated in the upper rotational motor-side space 19*a* by the rotation of the rotor 12 is not transmitted to the upper discharge pipe-side space 19*b*. Further, the porous plates 56*a*, 56*b*, 56*c* are fixed to elements other than the rotor 12 and the shaft 2 and are not rotated. Thus, the turning flow caused by the porous plates 56*a*, 56*b*, 56*c* in the upper discharge pipe-side space 19*b* is not generated.

Therefore, according to the rotary compressor of this embodiment, the working fluid passes through the porous plates 56*a*, 56*b* and 56*c* and flows into the upper discharge pipe-side space 19*b*, the flow speed of the working fluid is not increased by the turning flow, and the ability of the working fluid to transport the oil drops of the refrigeration oil is reduced as compared with the conventional compressor. Thus, the oil separating effect by the density difference between the working fluid and the refrigeration oil in the upper discharge pipe-side space 19*b* is enhanced. Further, since the oil drops of the refrigeration oil are not finely divided by the turning flow, the oil separating effect by the density difference between the working fluid and the refrigeration oil is further enhanced.

As described above, since the porous plates 56*a*, 56*b*, 56*c* are provided, most of oil drops are separated from working fluid which passes through the porous plates 56*a*, 56*b* and 56*c* and flows into the upper discharge pipe-side space 19*b* from the upper rotational motor-side space 19*a* where stirring effect is generated by the turning flow and the rotation of the asperities such as the balancer weight 12*d* of the rotor 12. The turning flow is not transmitted to the upper discharge pipe-side space 19*b*. Therefore, the oil separating effect in the upper discharge pipe-side space 19*b* is enhanced, and the mass of the refrigeration oil included in the working fluid discharged from the discharge pipe 15 is reduced.

Since the porous plates 55*a*, 55*b*, 55*c* are fixed to the upper bearing member 7 which supports the shaft 2, it is easy to position the porous plates in the direction along the center axis L in the space between the rotational motor and the discharge pipe, and especially since the positioning member such as a spacer is unnecessary, the compressor can be produced inexpensively. Similarly, since the porous plates 56*a*, 56*b* and 56*c* are fixed to the inner side surface of the container 1, it is easy to position the porous plates in the direction along the center axis L in the space between the rotational motor and the discharge pipe, and especially since the positioning member such as a spacer is unnecessary, the compressor can be produced inexpensively.

Since the porous plates 55*a*, 55*b*, 55*c* are fitted and fixed to the ring groove 7*e*, 7*f* and 7*g*, the compressor can be assembled without using fixing parts such as a bolt, and the compressor can be produced inexpensively.

Since the space is defined by the porous plates 55*a*, 55*b*, 55*c* and the porous plates 56*a*, 56*b* and 56*c* such as the honeycomb or the punching metal, the porous plates 55*a*, 55*b*, 55*c* can be provided with the through holes which can be fitted to the projection 7*b* of the upper bearing member 7, and it is easy to form the porous plates 55*a*, 55*b*, 55*c* into the circular shape which can just accommodated in the inner side surface of the container 1 and thus, the compressor can be produced inexpensively.

Since the porous plate 55*c* and the porous plate 56*a* are of the plate-like shape, the surfaces of the porous plate 55*c* and the porous plate 56*a* which come into contact with the turning flow generated in the lower rotational motor-side space 17*b* and the upper rotational motor-side space 19*a* are flat. Therefore, turbulence caused by peel of the turning flow is not easily generated on the surfaces of the porous plate 55*c* and the porous plate 56*a*. Thus, the efficiency of the compressor is not deteriorated by loss of kinetic energy caused by turbulent flow.

If the porous plates 55*a*, 55*b*, 55*c* and the porous plates 56*a*, 56*b* and 56*c* are made of non-magnetic material, the influence acting on the magnetic circuit of the rotational motor is small, and the oil separating efficiency can be enhanced without deteriorating the efficiency of the rotational motor.

Since at least the porous plate 55*c* and the porous plate 56*a* which are opposed to the rotational motor are made of insulative material such as resin and ceramic, the porous plate 55*c* and the porous plate 56*a* can be disposed in contact with the coil end 11*c* and the coil end 11*d* of the stator 11. Thus, it is unnecessary to provide a gap between the coil end 11*c* and the coil end 11*d* to take the electrical insulation performance into consideration. Thus, it is unnecessary to increase the compressor in size so as to secure the gap between the coil end 11*c* and the coil end 11*d*, and the embodiment can be realized in the container 1 having the same size as that of the conventional container.

It is preferable that the surface of the porous plate 55 is lipophobic. If the surface of the porous plate 55 is lipophobic, the refrigeration oil is not easily held on the surface of the porous plate 55. Thus, the refrigeration oil attaches the porous plate 55 and a particle diameter of the refrigeration oil is increased, and the refrigeration oil is prone to fall downward of the porous plate 55 by the density difference. Therefore, refrigeration oil separated from the working fluid can easily return to the oil reservoir 16.

The vertical rotary compressor is explained in this embodiment, but if most of working fluid discharged from the compression mechanism passes in the vicinity of the rotor 12 until the working fluid is discharged from the discharge pipe 15 provided in the container 1 irrespective of the difference between the vertical type and the lateral type, or irrespective of the difference of compressing manners, the same effect can be obtained.

In a compressor in which the working fluid injected from the discharge hole 7*a* collides directly against the lower end surface 12*a* of the rotor 12 like the conventional rotary compressor, the effect for defining the lower space 17 or the upper space 19 by the porous member 55 or the porous member 56 is exhibited more remarkably.

Sixth Embodiment

Figure 9:
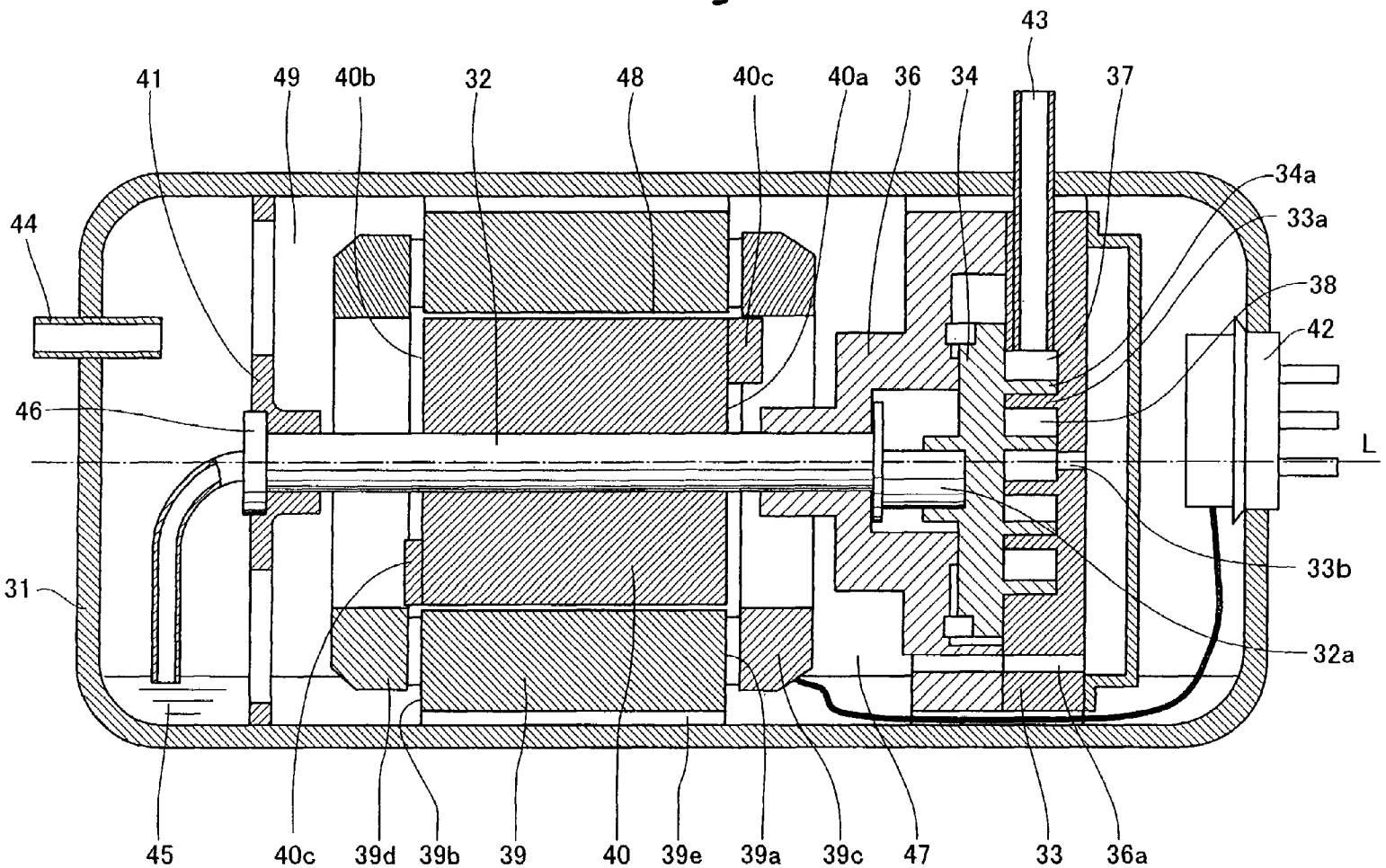
PRIOR ART Fig. 9
FIG. 9 is a vertical sectional view of a conventional scroll compressor.
Figure 10:
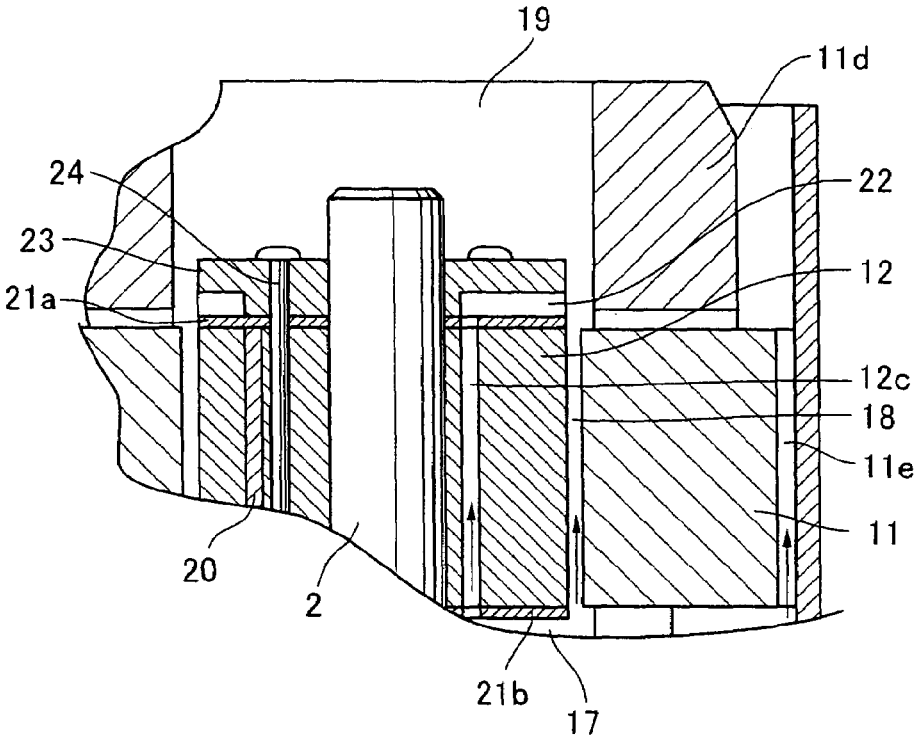
Fig. 10 PRIOR ART
FIG. 10 is a detailed sectional view of a periphery of an oil separating plate of a conventional compressor.
Figure 11:
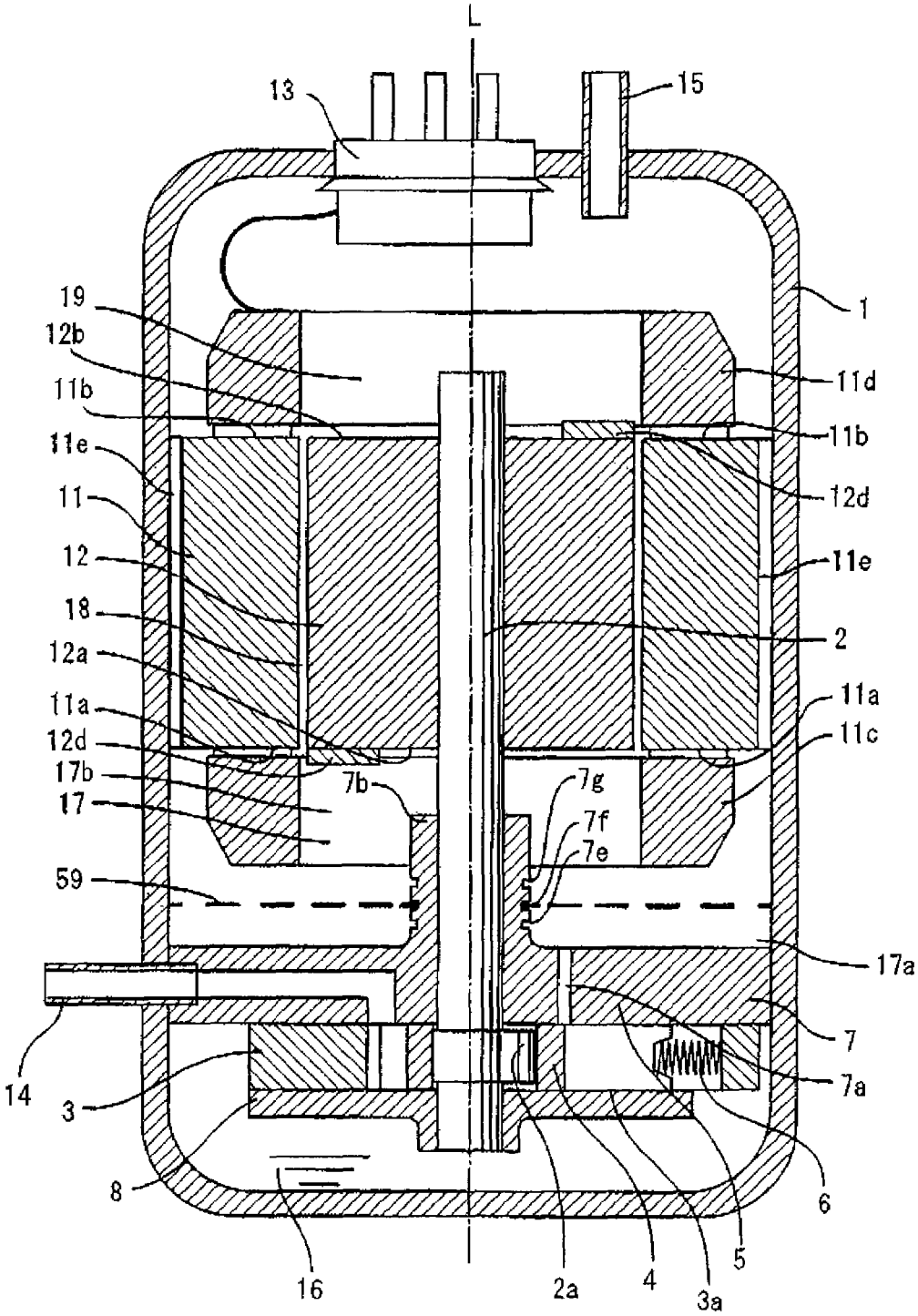
FIG. 11 is a vertical sectional view of a compressor of the invention showing two different sizes holes one which is closer to a central portion of the porous plate and another one that is closer to an outer periphery of the porous plate.

A compressor of a sixth embodiment of the present invention is a scroll compressor, and is similar to the conventional scroll compressor explained using FIG. 9. The same elements are designated with the same symbols. Explanation of the same structure and operation will be omitted.

Figure 7:
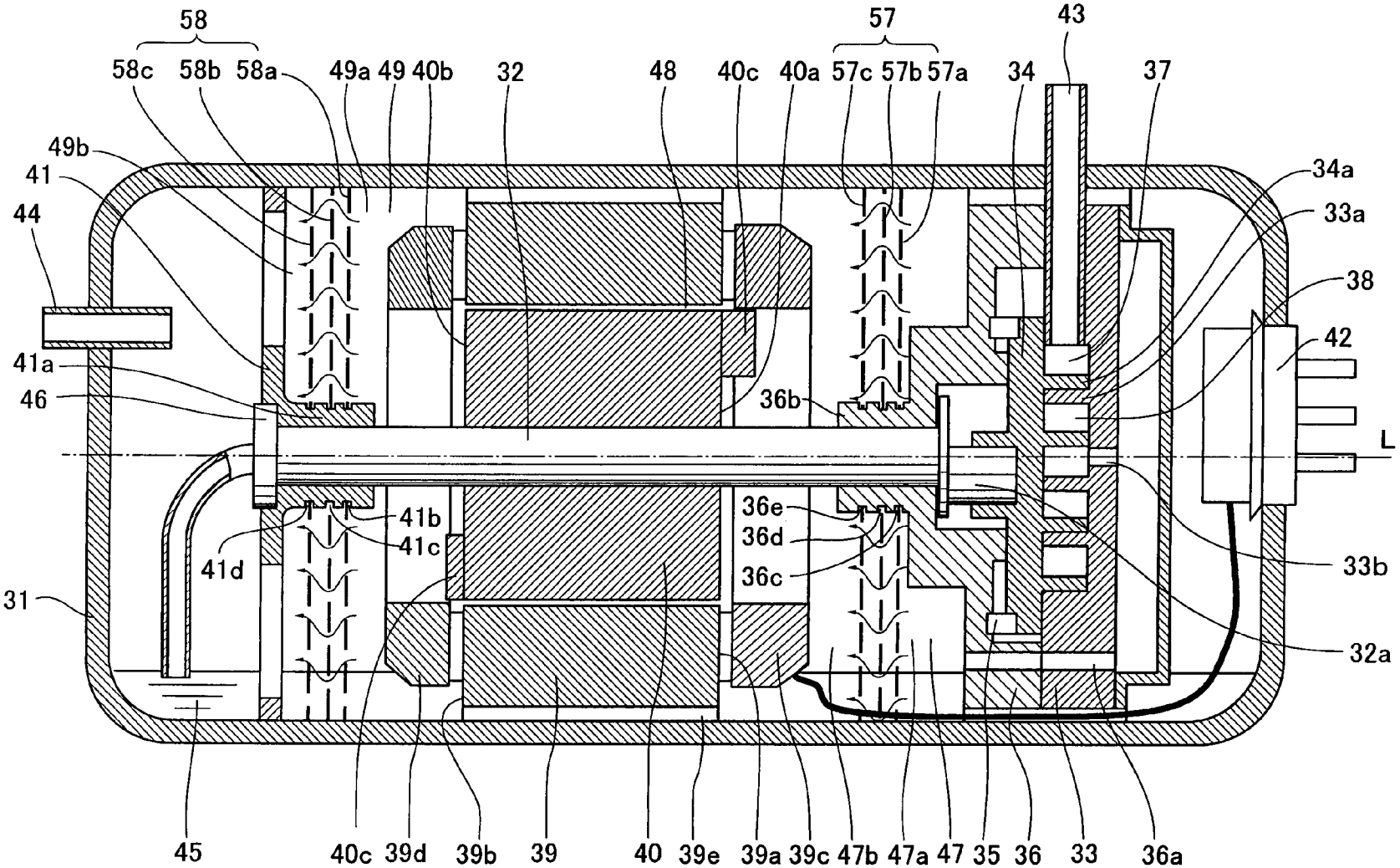
FIG. 7 is a vertical sectional view of a scroll compressor according to a sixth embodiment of the invention.

FIG. 7 is a vertical sectional view of the scroll compressor according to the sixth embodiment of the invention.

The illustrated scroll compressor comprises a container 31, a compression mechanism disposed on the right side in the container 31 and a rotational motor disposed on the left side in the container 31. The compression mechanism can rotate around the center axis L. The compression mechanism includes a shaft 32 having an eccentric portion 32*a*, a stationary scroll 33 having a spiral lap 33*a* such as an involute and a discharge hole 33*b*, a moving scroll 34, an Oldham ring 35 which prevents the moving scroll 34 from rotating, and a bearing member 36 having a discharge hole 36*a* and a projection 36*b*. The moving scroll 34 is opposed to the stationary scroll 33, and has a spiral lap 34*a*. The moving scroll 34 is disposed such that the laps 33*a* and 34*a* mesh with each other. The moving scroll 34 turns as the eccentric portion 32*a* eccentrically rotates. The bearing member 36 supports the shaft 32. A plurality of suction chambers 37 and compression chambers 38 are formed between the stationary scroll 33 and the moving scroll 34.

The rotational motor includes a stator 39 which is shrinkage fitted into the container 31 and a rotor 40 which is shrinkage fitted over the shaft 32. The stator 39 is provided with a coil end 39*c* projecting from a right end surface 39*a* of the stator 39, and a coil end 39*d* projecting a left end surface 39*b* of the stator 39. The stator 39 comprises laminated steel plates from its right end surface 39*a* to its left end surface 39*b*. A right end surface 40*a* and a left end surface 40*b* of the rotor 40 can be provided with balancers 40*c* if necessary.

Porous plates 57*a*, 57*b* and 57*c* are mounted to the projection 36*b* of the bearing member 36. The porous plates 57*a*, 57*b* and 57*c* define a right space 47 between the rotational motor and the compression mechanism into a right compression mechanism-side space 47*a* and a right rotational motor-side space 47*b*. An auxiliary bearing member 41 is disposed on the left side of the rotational motor on the opposite side from the bearing member 36 with respect to the rotor 40. The auxiliary bearing member 41 supports the shaft 32. Porous plates 58*a*, 58*b* and 58*c* are mounted to a projection 41*a* of the auxiliary bearing member 41 for defining a left space 49 between the rotational motor and a discharge pipe 44 into a right rotational motor-side space 49*a* and a left discharge pipe-side space 49*b*.

A plurality of notches 39*e* function as passages of the working fluid is provided between the outer periphery of the stator 39 and the inner wall of the container 31. A gap 48 is provided between the stator 39 and the rotor 40. The projection 36*b* is provided with ring grooves 36*c*, 36*d* and 36*e*, and the projection 41*a* is provided with ring grooves 41*b*, 41*c* and 41*d*.

The container 31 is provided at its wall with an introduction terminal 42 for energizing the stator 39 outside of the container 31, a suction pipe 43 for introducing working fluid from the refrigeration cycle to a suction chambers 37, and a discharge pipe 44 for discharging the working fluid into the refrigeration cycle from the container 31. Refrigeration oil is reserved in an oil reservoir 45 formed in a bottom of the container 31. The refrigeration oil is pumped up from the oil reservoir 45 by a lubrication pump 46 to supply the refrigeration oil into the compression mechanism through an oil-supply hole (not shown) of the shaft 32.

As compared with the conventional scroll compressor shown in FIG. 9, the scroll compressor of this embodiment is characterized in that one of the porous members 57 comprising the porous plates 57*a*, 57*b* and 57*c* are provided in the right space 47 of the rotational motor, and the other porous member 58 comprising the porous plates 58*a*, 58*b* and 58*c* is provided in the left space 49 of the rotational motor. That is, the disk-like porous plates 57*a*, 57*b* and 57*c* and porous plates 58*a*, 58*b* and 58*c* comprising honeycomb or punching metal made of resin or ceramic are used as the porous members 57 and 58 provided in the right space 47 and the left space 49, respectively.

The outer periphery of the projection 36*b* of the bearing member 36 is provided with the three annular ring grooves 36*c*, 36*d* and 36*e* from the right in this order. The porous plates 57*a*, 57*b* and 57*c* are provided at their central portions with the through holes which can be fitted to the ring grooves. The porous plates 57*a*, 57*b* and 57*c* are fitted and fixed to the ring grooves 36*c*, 36*d* and 36*e*, and the right space 47 of the rotational motor is defined into a right compression mechanism-side space 47*a* on the side of the compression mechanism and a right rotational motor-side space 47*b* on the side of the rotational motor.

The auxiliary bearing member 41 is provided with the projection 41*a* which projects to a portion near the left end surface 40*b* of the rotor 40. The outer periphery of the projection 41*a* of the auxiliary bearing member 41 is provided with the three annular ring grooves 41*c*, 41*d* and 41*e* from the right to the left in this order. The porous plates 58*a*, 58*b* and 58*c* are provided at their central portions with through holes which can be fitted to the ring grooves. The porous plates 58*a*, 58*b* and 58*c* are fitted and fixed to the ring grooves 41*c*, 41*d* and 41*e*, and the left space 49 of the rotational motor is defined into a left rotational motor-side space 49*a* on the side of the rotational motor and a left discharge pipe-side space 49*b* on the side of the discharge pipe 42.

The porous plates 57*a*, 57*b*, 57*c*, 58*a*, 58*b* and 58*c* are substantially perpendicular to the center axis L. The porous plates 57*a*, 57*b*, 57*c*, 58*a*, 58*b* and 58*c* has a plurality of small holes, and the positions of the small holes in the porous plates are different from each other. The small hole closer to the central portion has a smaller diameter.

Although the porous member 57 comprises three porous plates 57*a*, 57*b* and 57*c* laminated on one another in this embodiment, the porous member 57 may comprises at least one porous plate 57*a*. Similarly, the porous member 58 may comprise the three porous plates 58*a*, 58*b* and 58*c* to one porous plate 58*a*. At least one of the porous member 57 and porous member 58 may be provided. In the following explanation, the porous plates 57*a*, 57*b* and 57*c* may be called as the porous member 57, and the porous plates 58*a*, 58*b* and 58*c* may be called as the porous member 58.

The operation of the scroll compressor having the above structure will be explained.

If the stator 39 is energized through the introduction terminal 42 to rotate the rotor 40, the moving scroll 34 turns, and volumes of the suction chambers 37 and the compression chambers 38 formed between the laps 33*a* and 34*a* of the stationary scroll 33 and the moving scroll 34 are varied. With this, working fluid is sucked into the suction chambers 37 from the suction pipe 43, and is compressed in the compression chambers 38. The compressed working fluid is supplied from the oil reservoir 45 to lubricate the sliding surface of the compression mechanism, and in a state in which the oil drops of refrigeration oil which seal the gap are mixed into the working fluid, the working fluid is injected into the right space 47 which is a flowing place of the working fluid between the compression mechanism and the rotational motor through the discharge holes 33*b* and 36*a*.

The working fluid injected into the right space 47 stays in the right compression mechanism-side space 47*a* defined by the porous member 57 and where the working fluid is not influence by the rotation of the rotor 12. While the working fluid stays in the right compression mechanism-side space 47*a*, a portion of the oil drops included in the working fluid attaches to the inner wall of the container 31 or falls downward due to the gravity and is separated from the working fluid and returns into the oil reservoir 45.

Thereafter, the working fluid passes through the porous member 57. At that time, since the flow speed of the working fluid is reduced, the oil drops are separated from the working fluid in the porous member 57. The working fluid which passed through the porous member 57 flows into the right rotational motor-side space 47*b*, the working fluid generates turning flow by the influence of the rotation of the rotor 12, and a portion of the oil drops included in the working fluid attaches to the inner wall of the container 31 by the centrifugal force of the turning flow or falls due to the gravity and is separated from the working fluid and returns into the oil reservoir 45.

The working fluid passes through the notches 39*e* and the gap 48 from the right rotational motor-side space 47*b*, and flows into the left space 49 which is a flowing place of the working fluid between the rotational motor and the discharge pipe 44. The working fluid which flowed into the left space 49 generates turning flow by the influence of the rotation of the rotor 12 in the left rotational motor-side space 49*a* defined by the porous member 58. A portion of the oil drops included in the working fluid attaches to the inner wall of the container 31 by the centrifugal force of the turning flow or falls due to the gravity and is separated from the working fluid and returns into the oil reservoir 45.

Thereafter, the working fluid passes through the porous member 58. At that time, since the flow speed of the working fluid is reduced, the oil drops are separated from the working fluid in the porous member 58. The working fluid which passed through the porous member 58 flows into the left discharge pipe-side space 49*b* defined by the porous member 56 and where the working fluid is not influenced by the rotation of the rotor 12, and stays therein. While the working fluid stays in the left discharge pipe-side space 49*b*, a portion of the oil drops included in the working fluid attaches to the inner wall of the container 31 or falls due to the gravity and is separated from the working fluid and returns into the oil reservoir 45. Then, the working fluid is discharged from the discharge pipe 44.

With this above structure, the compressor of the sixth embodiment is the same as that of the fifth embodiment except in that the compression mechanism of the compressor of the fifth embodiment is changed from the rotary type to the scroll type and from the vertical type to the lateral type, and the porous plates 58*a*, 58*b* and 58*c* are fixed to the auxiliary bearing member 41. According to the scroll compressor of the sixth embodiment, the same effect as that of the fifth embodiment can be obtained and the oil separating efficiency can be enhanced.

The porous plates 57*a*, 57*b*, 57*c*, 58*a*, 58*b* and 58*c* are mounted on the bearing member 36 or the auxiliary bearing member 41 which are portions of the compression mechanism. With this, the rotational motor used in the conventional compressor can be used as it is, and the compressor can be produced inexpensively.

Since the porous plates 57*a*, 57*b*, 57*c*, 58*a*, 58*b* and 58*c* are mounted on the projection 36*b* of the bearing member 36 or the projection 41*a* of the auxiliary bearing member 41, it is unnecessary to add a new supporting member such as a column, the porous plates 57*a*, 57*b*, 57*c*, 58*a*, 58*b* and 58*c* can be provided using a simple structure, and the compressor can be produced inexpensively.

Since the porous plates 57*a*, 57*b*, 57*c*, 58*a*, 58*b* and 58*c* are mounted on the ring grooves 36*c*, 36*d*, 36*e*, 41*b*, 41*c* and 41*d* provided on the outer periphery of the projection 36*b* 41*a*, the compressor can be assembled without using a fixing parts such as bolts, and the compressor can be produced inexpensively.

The effects of the embodiments can be obtained irrespective of kinds of the working fluid, but especially when carbon dioxide is used as the working fluid, remarkable effect can be obtained. That is, in the case of a refrigeration cycle using working fluid comprising carbon dioxide as main ingredient, since the working fluid discharged from the compression mechanism is brought into a supercritical state, an amount of refrigeration oil dissolved in the working fluid is increased, and oil separating effect in the container becomes more difficult. If such carbon dioxide is used in combination with the compressor of any of the first to sixth embodiments, it is possible to prevent the working fluid from being stirred and thus, the oil separating efficiency of the refrigeration oil can be enhanced. With this, it is possible to enhance the reliability of the compressor and the efficiency of the refrigeration cycle using the compressor, and there is a merit that the carbon dioxide as an environment-friendly refrigerant can be used as the working fluid.

INDUSTRIAL APPLICABILITY

As described above, the present invention is applied to a compressor having lubricant oil, and is suitable as a compressor used for a refrigeration cycle such as a refrigerator-freezer, an air conditioner, a boiler and the like.

The invention claimed is:

1. A compressor comprising a compression mechanism for compressing working fluid, a rotational motor including a stator, a rotor for driving said compression mechanism and a container for accommodating said compression mechanism and said rotational motor, in which the compressed working fluid flows from said compression mechanism to said rotational motor, wherein a space between said compression mechanism and said rotational motor is divided by a porous member through which the working fluid passes,and central portion of said porous member is thicker than an outer periphery of the porous member, and further comprising a discharge pipe provided on the opposite side from the compression mechanism with respect to the porous member;

wherein the compressed working fluid is discharged into a lower compression mechanism side space which is defined between the porous member and the compression mechanism.

2. A compressor comprising a compression mechanism for compressing working fluid, a rotational motor including a stator, a rotor for driving said compression mechanism and a container for accommodating said compression mechanism and said rotational motor, in which said container includes a discharge pipe provided on the opposite side of said compression mechanism with respect to said rotational motor and on the opposite side from the compression mechanism with respect to the porous member, and wherein the compressed working fluid flows from said rotational motor to said discharge pipe, wherein a space between said compression mechanism and said rotational motor is divided by a porous member through which the working fluid passes,and a central portion of said porous member is thicker than an outer periphery of the porous member, and wherein the compressed working fluid is discharged into a lower compression mechanism side space which is defined between the porous member and the compression mechanism.

3. A compressor according to claim 1 or 2, wherein said porous member is mounted on an element other than said rotor and a shaft fixed to said rotor.

4. A compressor according to claim 3, wherein said compression mechanism includes a bearing member which supports said shaft, and said porous member is mounted on said bearing member.

5. A compressor according to claim 4, wherein said bearing member includes a projection provided on a side of said rotational motor, and said porous member is mounted on a groove formed in an outer peripheral surface of said projection.

6. A compressor according to claim 3, wherein said porous member is mounted on an inner wall of said container.

7. A compressor according to claim 3, wherein said compression mechanism includes a bearing member which supports said shaft and an auxiliary bearing member which supports said shaft together with said bearing member from both sides of the shaft on the opposite side from the bearing member with respect to said rotor.

8. A compressor according to claim 1 or 2, wherein said porous member is made of porous material selected from the group consisting of:porous metal and porous resin.

9. A compressor according to claim 8, wherein said porous member is formed into a plate-like shape.

10. A compressor according to claim 8, wherein a central portion of said porous member is thicker than an outer periphery of the porous member.

11. A compressor according to claim 1 or 2, wherein said porous member is made of mesh selected from the group consisting of: metal thin wire, glass wool and ceramic wool.

12. A compressor according to claim 11, wherein said mesh is enveloped by a plate member having an opening.

13. A compressor according to claim 1 or 2, wherein said porous member is made of porous plate selected from the group consisting of: honeycomb, and punching metal.

14. A compressor according to claim 13, wherein said porous plate comprises a plurality of porous plates laminated on one another.

15. A compressor according to claim 13, wherein said porous plate has holes, and a diameter of a hole closer to a central portion of said porous plate is smaller than that of a hole closer to an outer periphery of the porous plate.

16. A compressor according to claims 1 or 2, wherein said porous member is made of non-magnetic material.

17. A compressor according to claim 1 or 2, wherein said porous member is made of insulative material.

18. A compressor according to claim 1 or 2, wherein carbon dioxide is used as the working fluid.

19. A compressor according to claim 1 or 2, wherein said compression mechanism is of a rotary type.

20. A compressor according to claim 1 or 2, wherein said compression mechanism is of a scroll type.

21. A compressor comprising a compression mechanism for compresing working fluid, a rotational motor including a stator, a rotor for driving said compression mechanism and a container for accommodating said compression mechanism and said rotational motor, in which the compressed working fluid flows from said compression mechanism to said rotational motor, wherein a space between said compression mechanism and said rotational motor is divided by a porous member through which the working fluid passes, said porous member is made of porous plate selected from the group consisting of: honeycomb and punching metal, and said porous plate has holes, a diameter of a hole closer to a central portion of said porous plate is smaller than that of a hole closer to an outer periphery of the porous plate, and further comprising a discharge pipe provided on the opposite side from the compression mechanism with respect to the porous member;

wherein the compressed working fluid is discharged into a lower compression mechanism side space which is defined between the porous member and the compression mechanism.

22. A compressor according to claim 21, wherein the porous member is mounted on an upper bearing member, said bearing member being said compression mechanism and said rotational motor.

23. A compressor comprising a compression mechanism for compressing working fluid, a rotational motor including a stator, a rotor for driving said compression mechanism and a container for accommodating said compression mechanism and said rotational motor, in which said container includes a discharge pipe on the opposite side of said compression mechanism with respect to said rotational motor, and wherein the compressed working fluid flows from said rotational motor to said discharge pipe, wherein a space between said compression mechanism and said rotational motor is divided by a porous member through which the working fluid passes, said porous member is made of porous plate selected from the group consisting of: honeycomb and punching metal, and said porous plate has holes, a diameter of a hole closer to a central portion of said porous plate is smaller than that of a hole closer to an outer periphery of the porous plate, and further comprising a discharge pipe provided on the opposite side from the compression mechanism with respect to the porous member;

wherein the compressed working fluid is discharged into a lower compression mechanism side space which is defined between the porous member and the compression mechanism.

24. A compressor according to claim 23, wherein the porous member is mounted on an upper bearing member, said bearing member being said compression mechanism and said rotational motor.

25. A compressor comprising a compression mechanism for compressing working fluid, a rotational motor including a stator, a rotor for driving said compression mechanism and a container for accommodating said compression mechanism and said rotational motor, in which the compressed working fluid flows from said compression mechanism to said rotational motor, wherein a space between said compression mechanism and said rotational motor is divided by a porous member through which the working fluid passes, and a central portion of said porous member is thicker than an outer periphery of the porous member, and further comprising a discharge pipe provided on the opposite side from the compression mechanism with respect to the porous member;

wherein the compressed working fluid is discharge into a lower compression mechanism side space which is defined between the porous member and the compression mechanism, wherein said porous member made of mesh selected from the group consisting of: metal thin wire, glass wool and ceramic wool, and wherein a central portion of said mesh is higher density than that of an outer periphery of the mesh.

26. A compressor comprising a compression mechanism for compressing working fluid, a rotational motor including a stator, a rotor for driving said compression mechanism and a container for accommodating said compression mechanism and said rotational motor, in which said container includes a discharge pipe provided on the opposite side of said compression mechanism with respect to said rotational motor, and the compressed working fluid flows from said rotational motor to said discharge pipe, wherein a space between said compression mechanism and said rotational motor is divided by a porous member through which the working fluid passes, and a central portion of said porous member is thicker than an outer periphery of the porous member, and further comprising a discharge pipe provided on the opposite side from the compression mechanism with respect to the porous member;

wherein the compressed working fluid is discharged into a lower compression mechanism side space which is defined between the porous member and the compression mechanism, wherein said porous member is made of mesh selected from the group consisting of: metal thin wire, glass wool and ceramic wool, and wherein a central portion of said mesh is higher density than that of an outer periphery of the mesh.

* * * * *